US006733948B2

(12) United States Patent
Nakamura et al.

(10) Patent No.: US 6,733,948 B2
(45) Date of Patent: May 11, 2004

(54) NEGATIVE IMAGE-RECORDING MATERIAL

(75) Inventors: Ippei Nakamura, Shizuoka-ken (JP); Tadahiro Sorori, Shizuoka-ken (JP)

(73) Assignee: Fuji Photo Film Co., Ltd., Minami-Ashigari (JP)

( * ) Notice: Subject to any disclaimer, the term of this patent is extended or adjusted under 35 U.S.C. 154(b) by 112 days.

(21) Appl. No.: 09/928,447

(22) Filed: Aug. 14, 2001

(65) Prior Publication Data

US 2002/0051934 A1 May 2, 2002

(30) Foreign Application Priority Data

Sep. 8, 2000 (JP) ..... 2000-273429

(51) Int. Cl.[7] ..... G03C 1/52

(52) U.S. Cl. ..... 430/157; 430/176; 430/270.1; 430/281.1; 430/283.1; 430/285.1; 430/288.1; 430/302

(58) Field of Search ..... 430/157, 176, 430/270.1, 281.1, 283.1, 285.1, 288.1, 302

(56) References Cited

U.S. PATENT DOCUMENTS

| | | | | |
|---|---|---|---|---|
| 4,800,149 | A | 1/1989 | Gottschalk et al. | |
| 4,859,572 | A | 8/1989 | Farid et al. | |
| 4,971,892 | A | 11/1990 | Ali et al. | |
| 5,093,492 | A | 3/1992 | Acker et al. | |
| 5,151,520 | A | 9/1992 | Gottschalk et al. | |
| 5,658,708 | A | 8/1997 | Kondo | |
| 5,672,463 | A * | 9/1997 | Hozumi et al. | 430/281.1 |
| 5,719,008 | A * | 2/1998 | Hozumi et al. | 430/287.1 |
| 5,814,431 | A | 9/1998 | Nagasaka et al. | |
| 6,096,794 | A * | 8/2000 | Cunningham et al. | 522/12 |
| 6,159,657 | A | 12/2000 | Fleming et al. | |
| 6,235,451 | B1 | 5/2001 | Damme et al. | |
| 6,306,555 | B1 * | 10/2001 | Schulz et al. | 430/270.1 |
| 6,322,950 | B1 | 11/2001 | Sorori et al. | |
| 6,383,717 | B1 | 5/2002 | Fiebag et al. | |
| 6,410,202 | B1 | 6/2002 | Fleming et al. | |
| 6,423,462 | B1 | 7/2002 | Kunita | |
| 6,423,467 | B1 * | 7/2002 | Kawauchi et al. | 430/270.1 |
| 6,423,469 | B1 | 7/2002 | DoMinh et al. | |
| 6,447,979 | B1 * | 9/2002 | Hattori et al. | 430/270.1 |
| 6,492,093 | B2 | 12/2002 | Gaschler et al. | |
| 6,602,648 | B2 * | 8/2003 | Nakamura | 430/270.1 |
| 2001/0008748 | A1 | 7/2001 | Busman et al. | |
| 2002/0051934 | A1 | 5/2002 | Nakamura et al. | |
| 2002/0197564 | A1 | 12/2002 | Timpe et al. | |
| 2003/0003399 | A1 | 1/2003 | Muller et al. | |

FOREIGN PATENT DOCUMENTS

| | | |
|---|---|---|
| EP | 0 949 539 A2 | 10/1999 |
| EP | 1 096 315 A1 | 5/2001 |
| JP | 2001-125260 A | 5/2001 |

* cited by examiner

*Primary Examiner*—John S. Chu
(74) *Attorney, Agent, or Firm*—Burns, Doane, Swecker & Mathis, L.L.P.

(57) ABSTRACT

A negative image-recording material which can be imagewise exposed to IR radiation from IR lasers and ensures direct image formation from digital data of a computer or the like. The material, when used in a lithographic printing plate, ensures good hardenability in an image area and exhibits good printing durability, even if not heated for image formation, and ensures a large number of good prints from the printing plate. The recording material contains (A) an IR absorber, (B) a radical generator having an onium salt structure, (C) a radical-polymerizing compound, and (D) a reducing additive, and this is imagewise exposed to IR radiation for image formation. Preferably, the reducing additive (D) is highly reactive with radicals and a reaction product with a radical has high reductivity. Preferred examples of the reducing additive are ether-type hydrogen donors, alcohol-type hydrogen donors, vinyl ethers and phosphine-type compounds.

24 Claims, No Drawings

NEGATIVE IMAGE-RECORDING MATERIAL

BACKGROUND OF THE INVENTION

1. Field of the Invention

The present invention relates to an image-recording material usable for lithographic printing plates, color proofs, photoresists and color filters. In particular, the present invention relates to a negative image-recording material which can be directly processed by scanning with an IR laser on the basis of digital signals from a computer or the like, and which is therefore usable for directly-processable recording layers for lithographic printing plates.

2. Description of the Related Art

For a system of directly processing a recording material from digital data of a computer, heretofore proposed have been <1> electrophotography, <2> exposure of photopolymerization materials to blue or green-emitting lasers, <3> silver lamination on photosensitive resin, and <4> silver diffusion transfer photography.

However, these all have some drawbacks. Specifically, the image-forming process of electrophotography <1> is troublesome, in requiring complicated steps of electric charging, exposure to light and development, and this requires a complicated, large apparatus. Photopolymerizable plates for <2> are highly sensitive to blue and green light, and are difficult to handle in light rooms. In the processes of <3> and <4> using silver salts, development is troublesome, and, in addition, the wastes contain silver.

On the other hand, the recent development of laser technology has been remarkable, and high-power, small solid lasers and semiconductor lasers for emitting IR radiation within a wavelength range of from 760 nm to 1200 nm are easily available. For a light source for directly processing a recording material from digital data of a computer or the like, these lasers are extremely useful. However, many practicable photosensitive recording materials are sensitive to visible light falling within a wavelength range of at most 760 nm, to which, therefore, these IR lasers are not applicable for recording images thereon. Accordingly, recording materials capable of being processed with IR lasers are desired.

An image-recording material capable of being processed with an IR laser is described in U.S. Pat. No. 4,708,925, which features an onium salt, a phenolic resin and a color sensitizer. This is a positive image-recording material, in which the onium salt and the phenolic resin express dissolution resistance to developers, and is not a negative image-recording material as in the present invention. On the other hand, a negative image-recording material is disclosed in U.S. Pat. No. 5,340,699, which features an IR absorber, an acid generator, a resol resin and a novolak resin. For image formation thereon, however, this material requires heat treatment after exposure to a laser. Therefore, a negative image-recording material not requiring heat treatment after exposure to light has been desired.

For example, Japanese Patent Application Publication (JP-B) No. 7-103171 discloses a recording material that includes a cyanine dye having a specific structure, an iodonium salt, and an ethylenically unsaturated double bond-having addition-polymerizable compound. This does not require heat treatment after imagewise exposure to light. However, the strength of the image area of this material is low. Therefore, this is unfavorable for lithographic printing plates, as the number of prints from a lithographic printing plate is small. In addition, storage stability of a coating liquid for an image-recording layer of the material is not good. Therefore, if the coating liquid is used in producing lithographic printing plates after having been stored for a long period of time, non-image areas of prints from the printing plate are often stained, and, in addition, the strength of image areas of the printing plates is greatly lowered and the number of prints from the printing plates is further reduced.

SUMMARY OF THE INVENTION

An object of the present invention is to provide a negative image-recording material which can be imagewise exposed to IR radiation from an IR-emitting solid laser or semiconductor laser, which ensures direct image formation from digital data of a computer or the like, and which, when used in a lithographic printing plate, exhibits good printing durability, even if not heated for image formation thereon, and ensures a large number of good prints from the printing plate.

Having specifically noted the constituent components of negative image-recording materials and having assiduously studied them, we, the present inventors have found that the above-mentioned object can be attained when a cyanine dye having a specific partial structure is used as an IR absorber in a negative image-recording material. On the basis of this finding, we have completed the present invention.

The present invention provides a negative image-recording material for heat-mode exposure, which includes (A) an IR absorber, (B) a radical generator having an onium salt structure, (C) a radical-polymerizing compound, and (D) a reducing additive, and which is imagewise exposed to IR radiation for image formation.

Although not clear, the advantages of the negative image-recording material of the present invention may result from the addition of the reducing additive (D) to the material. Specifically, the reducing additive (D) added to the photosensitive layer of the negative image-recording material that includes (A) the IR absorber, (B) the radical generator having an onium salt structure and (C) the radical-polymerizing compound will promote decomposition of the onium salt serving as the radical generator in the layer, and will therefore promote polymerization of the radical-polymerizing compound therein to thereby increase the sensitivity of the layer. As a result, the film strength of the image area of the material processed for image formation may be increased and the printing durability of the material when used in printing plates may be thereby enhanced.

The mechanism by which the reducing additive promotes the decomposition of the onium salt-type radical generator is not clear. One presumed mechanism may be a redox-chain reaction of the reducing additive to decompose the onium salt, as in, for example, *Eur. Polym. J.*, p. vol. 23, p. 737 (1987); *J. Heterocycl. Chem.*, vol. 27, p. 1903 (1990); *Polymer*, vol. 32, p. 2289 (1991); *Thermchim. Acta.*, vol. 197, p. 285 (1992); *J. Org. Chem.*, vol. 59, p. 1381 (1994); *Macromol. Chem. Phys.*, vol. 198, p. 19 (1997); *Macromol. Symp.*, vol. 134, p. 177 (1998); and the like. The presumed decomposition mechanism of the reaction between an iodonium salt, one example of the onium salt-type radical generator, and a cyclic ether compound, one example of the reductive additive, is shown below.

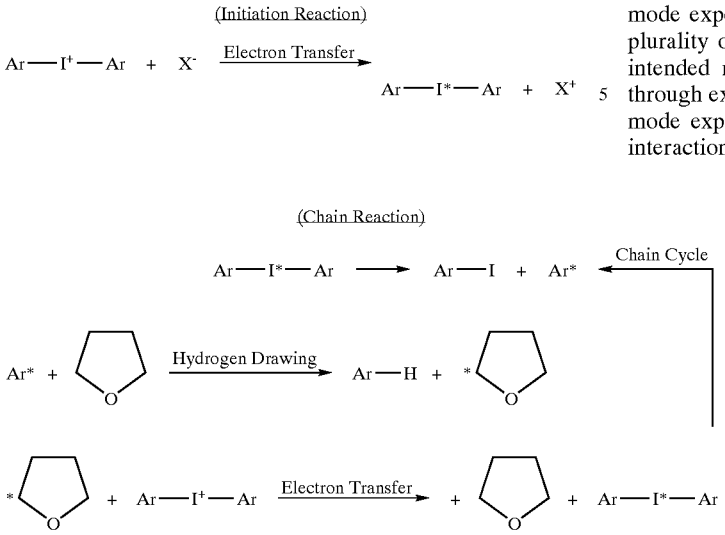

In the above presumed mechanism, the decomposition of the onium salt serving as a radical generator is accompanied by formation of a cationic compound derived from the reductive additive. Accordingly, some hardening reaction caused by the thus-formed cation will occur in the photosensitive layer of the recording material of the present invention. This will also be effective for increasing the film strength of the image area of the processed material and for enhancing the printing durability of the processed material in printing plates.

The recording material of the present invention is for "heat-mode exposure", and this means that the recording material is subjected to heat-mode exposure for image formation. The specifics of heat-mode exposure are described in detail below. As in Hans-Joachim Timpe, IS & Ts NIP 15:1999 *International Conference on Digital Printing Technologies*, page 209, it is known that, with regard to a process comprising photo-excitation of a light-absorbing substance (e.g., dye) in a photographic material followed by chemical or physical change thereof for image formation in a layer of the material, the process of image formation comprising photo-excitation of the light-absorbing substance followed by chemical or physical change thereof includes two major modes. Specifically, one is a photon mode in which the photo-excited light-absorbing substance in the photographic material is inactivated through photochemical interaction (for example, energy transfer or electron transfer) with another reactive substance in the material, and the reactive substance having been thus activated as a result of the interaction undergoes a chemical or physical change necessary for image formation in the layer of the material; and the other is a heat mode in which the photo-excited light-absorbing substance in the photographic material generates heat and is thus inactivated through the heat generation, and the other reactive substance in the material receives the heat and undergoes a chemical or physical change necessary for image formation in a layer of the material. Other minor modes of the process are omitted herein; for example, ablation, in which the substances in a photographic material are explosively scattered by some locally focused light energy, and multiphoton absorption, in which one molecule in a photographic material absorbs a number of photons all at one time.

The modes of the exposure process are referred to as photon-mode exposure and heat-mode exposure. The technical difference between photon-mode exposure and heat-mode exposure is whether or not energy quantities from a plurality of photons for exposure can be added up for the intended reaction. For example, referred to is a reaction through exposure to a number, n, of photons. In the photon-mode exposure, which takes advantage of photo-chemical interaction of the substances in a photographic material, the energy quantities from the n photons cannot be added up for the reaction because of laws of quantum energy and momentum conservation. In other words, every reaction through photon-mode exposure requires the condition "quantity of energy of one photon≧quantity of energy for one reaction". On the other hand, in the heat-mode exposure, the light-absorbing substance in the photographic material is first photo-excited to generate heat, and the heat thus having been converted from light energy serves for the reaction for image formation in a layer of the material. Accordingly, in the heat-mode exposure, the energy quantities of all n photons can be added up for image formation. Therefore, the condition of "energy quantity of n photons≧energy quantity for one reaction" will be sufficient for the heat-mode exposure. However, the addition of the energy quantities in the heat-mode exposure is restricted by heat diffusion. Specifically, if an exposed area (reaction point) of a photographic material successively undergoes a subsequent photo-excitation and inactivation before heat generated therein by a previous photo-excitation and inactivation step goes out through heat diffusion, and therefore successively receives heat through successive photo-excitations and inactivations, then the heat quantities can be surely accumulated and added up to elevate the temperature of that exposed area. However, if the heat generation in the subsequent step is too late, the heat generated in the previous step will go out of the area through heat diffusion. In other words, in heat-mode exposure to a predetermined level of total energy, a case of short-time exposure to higher energy and a case of long-time exposure to lower energy produce different results, and the former case of short-time exposure to higher energy is more advantageous than the latter case.

Needless-to-say, the photon-mode exposure may also undergo the same phenomenon as above, being influenced by subsequent reaction diffusions, but is basically free from this phenomenon.

The difference between the photon-mode exposure and the heat-mode exposure will be discussed with respect to the characteristics of a photographic material to be processed. In the photon-mode exposure, intrinsic sensitivity (the quantity of energy necessary for the reaction for image formation) of a photographic material is always constant relative to the exposure power density ($W/cm^2$) (=energy density per unit exposure time); but in the heat-mode exposure, the intrinsic sensitivity increases with an increase in the exposure power density. Now, the exposure time is fixed to suffice for practicable image-recording materials, and the two modes are compared for the thus-fixed exposure time. In photon-mode exposure, in general, a low degree of energy of about 0.1 mJ/cm$^2$ or so may be enough for high-sensitivity exposure of the materials, but even a slight amount of exposure will cause photo-reaction in the materials. Therefore, in this mode, the materials often involve a problem of low-exposure fogging in a non-exposed area. On the other hand, in heat-mode exposure, the photographic materials do not undergo photo-reaction if the amount of exposure is not above a certain level. In this mode, in general, the photographic materials require a level of exposure energy of 50 mJ/cm$^2$ or so, in view of their thermal stability, and are therefore free from the problem of low-exposure fogging in the non-exposed area.

In fact, in heat-mode exposure, photographic materials require an exposure power density of at least 5000 W/cm$^2$ on their surface, preferably at least 10000 W/cm$^2$. Though not described in detail herein, high-power density lasers of higher than $5.0\times10^5$ W/cm$^2$ are undesirable, as they cause ablation and soil light sources and other units.

DESCRIPTION OF THE PREFERRED EMBODIMENTS

The present invention is described in detail hereinunder.

(A) IR absorber

The IR absorber (A) in the recording material of the present invention has the function of absorbing light that falls within a predetermined wavelength range and converting the light into heat. By the heat thus generated, that is, through heat-mode exposure to the light which the IR absorber (A) serving as a light-to-heat converting agent absorbs, the radical-generating onium salt of the component (B) also in the recording material (this will be described hereinunder) is decomposed to generate a radical.

The IR absorber for use herein is not specifically defined, and may be any IR absorber having the function of converting light which it has absorbed into heat. For this, generally used are IR-absorbing dyes and pigments that have an absorption peak in the wavelength range of ordinary image-recording IR lasers, between 760 nm and 1200 nm.

A dye may be any of commercially-available dyes and any of other known dyes, for example, those described in *Dye Handbook* (the Association of Organic Synthetic Chemistry, 1970). Specifically, examples include azo dyes, metal-complex azo dyes, pyrazolonazo dyes, naphthoquinone dyes, anthraquinone dyes, phthalocyanine dyes, carbonium dyes, quinonimine dyes, methine dyes, cyanine dyes, squarylium dyes, pyrylium salts, metal thiolate complexes and the like.

Preferred dyes for use herein include cyanine dyes such as those described in Japanese Patent Application Laid-Open (JP-A) Nos. 58-125246, 59-84356, 59-202829 and 60-78787; methine dyes as in JP-A Nos. 58-173696, 58-181690 and 58-194595; naphthoquinone dyes as in JP-A Nos. 58-112793, 58-224793, 59-48187, 59-73996, 60-52940 and 60-63744; squarylium dyes as in JP-A No. 58-112792; and cyanine dyes as in British Patent No. 434,875.

Also preferred for use herein are near-IR absorbing sensitizers such as those described in U.S. Pat. No. 5,156,938; substituted arylbenzo(thio)pyrylium salts as in U.S. Pat. No. 3,881,924; trimethine-thiapyrylium salts as in JP-A No. 57-142645 (U.S. Pat. No. 4,327,169); pyrylium compounds as in JP-A Nos. 58-181051, 58-220143, 59-41363, 59-84248, 59-84249, 59-146063 and 59-146061; cyanine dyes as in JP-A No. 59-216146; pentamethine-thiopyrylium salts as in U.S. Pat. No. 4,283,475; and pyrylium compounds as in JP-B Nos. 5-13514 and 5-19702.

Other examples preferred for the dyes for use herein are near-IR absorbing dyes of formulae (I) and (II) in U.S. Pat. No. 4,756,993.

Of these dyes, especially preferred are cyanine dyes, squarylium dyes, and (thio)pyrylium dyes. More preferred are cyanine dyes; and most preferred are cyanine dyes of the following general formula (I):

General formula (I)

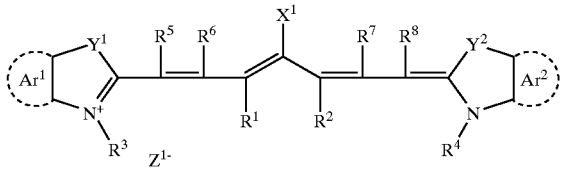

In general formula (I), $X^1$ represents a halogen atom, $X^2$—$L^1$ or $X^2$—$(L^1)_2$; $X^2$ represents an oxygen, sulfur or nitrogen atom; $L^1$ represents a hydrocarbon group having from 1 to 12 carbon atoms, or a heterocyclic group; and $R^1$ and $R^2$ each independently represents a hydrocarbon group having from 1 to 12 carbon atoms. In view of storage stability of a coating liquid for a photosensitive layer containing the dye, $R^1$ and $R^2$ each is preferably a hydrocarbon group having at least 2 carbon atoms; more preferably, $R^1$ and $R^2$ are bonded to each other to form a 5-membered or 6-membered ring.

$Ar^1$ and $Ar^2$ may be the same or different, and each represents an optionally-substituted aromatic hydrocarbon group. Preferably, the aromatic hydrocarbon group is a benzene ring or a naphthalene ring. Preferred substituents include a hydrocarbon group having at most 12 carbon atoms, a halogen atom, and an alkoxy group having at most 12 carbon atoms. $Y^1$ and $Y^2$ may be the same or different, and each represents a sulfur atom or a dialkylmethylene group having at most 12 carbon atoms. $R^3$ and $R^4$ may be the same or different, and each represents an optionally-substituted hydrocarbon group having at most 20 carbon atoms. Preferred substituents include an alkoxy group having at most 12 carbon atoms, a carboxyl group, and a sulfo group. $R^5$, $R^6$, $R^7$ and $R^8$ may be the same or different, and each represents a hydrogen atom, or a hydrocarbon group having at most 12 carbon atoms. Preferably, these are hydrogen atoms, as starting materials for the dyes will be more easily available. $Z^{1-}$ represents a counter ion required for charge neutralization. However, in a case where any of $R^1$ to $R^8$ is substituted with a sulfo group, $Z^{1-}$ is unnecessary. In view of the storage stability of the coating liquid for the photosensitive layer containing the dye, $Z^{1-}$ is preferably a halide ion, a perchlorate ion, a tetrafluoroborate ion, a hexafluorophosphate ion, or a sulfonate ion, and more preferably a perchlorate ion, a hexafluorophosphate ion or an arylsulfonate ion.

Specific examples of preferred cyanine dyes of formula (I) for use in the present invention are described in paragraphs [0017] to [0019] in Japanese Patent Application Laid-Open (JP-A) No. 2001-133969, and paragraphs [0032] to [0035] in Japanese Patent Application No. 2000-224031.

The pigments for use in the present invention may be any of commercially-available pigments and any of other known pigments, for example, those described in *Color Index* (*C.I.*) *Handbook; Latest Pigment Handbook* (the Pigment Technology Association of Japan, 1977); *Latest Pigment Appli-*

*cation Technology* (CMC, 1986); and *Printing Ink Technology* (CMC, 1984).

Various types of pigments are usable herein, including, for example, black pigments, yellow pigments, orange pigments, brown pigments, red pigments, violet pigments, blue pigments, green pigments, fluorescent pigments, metal powder pigments, and other polymer-bonded pigments. Specifically, examples include insoluble azo pigments, azo-lake pigments, condensed azo pigments, chelate-azo pigments, phthalocyanine pigments, anthraquinone pigments, perylene and perinone pigments, thioindigo pigments, quinacridone pigments, dioxazine pigments, isoindolinone pigments, quinophthalone pigments, dyed lake pigments, azine pigments, nitroso pigments, nitro pigments, natural pigments, fluorescent pigments, inorganic pigments, and carbon black. Of these, carbon black is preferred.

These pigments may be used without being surface-treated, or may be surface-treated. Surface treatments include a method of coating the surface with resin or wax; a method of adhering a surfactant; and a method of bonding a reactive substance (e.g., a silane coupling agent, epoxy compound, or polyisocyanate) to the surface. The methods of surface treatment as above are described in *Properties and Applications of Metal Soap* (Miyuki Publishing); *Printing Ink Technology* (CMC, 1984); and *Latest Pigment Application Technology* (CMC, 1986).

Preferably, the particle size of the pigment for use herein falls between 0.01 $\mu$m and 10 $\mu$m, more preferably between 0.05 $\mu$m and 1 $\mu$m, even more preferably between 0.1 $\mu$m and 1 $\mu$m. A particle size smaller than 0.01 $\mu$m is unfavorable since a pigment dispersion in a coating liquid for an image-forming photosensitive layer will not be stable; and a particle size larger than 10 $\mu$m is also unfavorable since such coarse pigment particles will not be uniform in an image-forming photosensitive layer.

For producing the pigment dispersion, employable is any known dispersion technology generally used in ink production or toner production. Dispersing machines include, for example, ultrasonic dispersers, sand mills, attritors, pearl mills, super mills, ball mills, impellers, dispersers, KADY mills, colloid mills, DYNATRON, three-roll mills and pressure kneaders. Details are described in *Latest Pigment Application Technology* (CMC, 1986).

Preferably, the IR absorber is in the image-recording material in an amount of from 0.1 to 20% by weight of total solid content of the material, more preferably from 1 to 15% by weight. An amount of the IR absorber in the material smaller than the preferred range is unfavorable since sensitivity of the material to a change of characteristics thereof through exposure will be low; but an amount larger than the range is also unfavorable since uniformity and strength of the film of the material will be lower.

In a case where the recording material has a cyanine dye as the IR absorber, it is desirable that optical density at an absorption peak in the IR range falls between 0.1 and 3.0. If the optical density exceeds this range, the sensitivity of the recording material will be low. The optical density is determined based on the amount of the JR absorber in the recording material and the thickness of the recording layer of the material. Therefore, a desired optical density may be attained by controlling these two conditions. The optical density of the recording layer may be measured in any ordinary manner. For example, the recording material of which the optical density is to be measured is applied to a transparent or white support to form thereon a recording layer whose dry thickness is within the range necessary for lithographic printing plates, and the transmittance of the recording layer is measured with a transmission densitometer; or the recording material is applied to a reflective support of, for example, aluminum to form a recording layer thereon, and the reflection density of this layer is measured.

One or more such IR absorbers may be in the recording layer either singly or combined. If desired, the IR absorber may be added to the same photosensitive layer of the material as other components; or may be in a separate layer, which may be applied with a layer containing the other components.

(B) Radical Generator having Onium Salt Structure

The component (B) radical generator having an onium salt structure (this will be hereinafter referred to as an onium salt) in the image-recording material of the present invention generates a radical due to exposure of the material to the light which the IR absorber (A) absorbs. The onium salt (B) is not specifically limited as long as it generates a radical through exposure of the image-recording material to the light that the IR absorber (A) absorbs, but is preferably any of iodonium salts, diazonium salts and sulfonium salts. Especially preferred are iodonium salts, in view of reactivity of radicals therefrom with the reducing additive in the recording material, and of stability of a recording material containing an iodonium salt. The onium salts for use in the present invention are not acid generators, but function as radical polymerization initiators. Preferred onium salts for use herein are those of the following general formulae (III) to (V):

General formula (III)

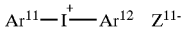

$$Ar^{11}-\overset{+}{I}-Ar^{12} \quad Z^{11-}$$

General formula (IV)

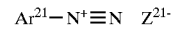

$$Ar^{21}-N^{+}\equiv N \quad Z^{21-}$$

General formula (V)

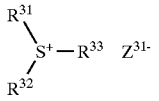

$$\begin{array}{l} R^{31} \\ \quad\diagdown \\ \quad\quad S^{+}-R^{33} \quad Z^{31-} \\ \quad\diagup \\ R^{32} \end{array}$$

In general formula (III), $Ar^{11}$ and $Ar^{12}$ each independently represents an optionally-substituted aryl group having at most 20 carbon atoms. Preferred examples of substituents therefor include a halogen atom, a nitro group, an alkyl group having at most 12 carbon atoms, an alkoxy group having at most 12 carbon atoms, and an aryloxy group having at most 12 carbon atoms. $Z^{11-}$ represents a counter ion selected from the group consisting of halide ions, perchlorate ions, tetrafluoroborate ions, hexafluorophosphate ions, carboxylate ions and sulfonate ions, and is preferably any of perchlorate ions, hexafluorophosphate ions and sulfonate ions.

In general formula (IV), $Ar^{21}$ represents an optionally-substituted aryl group having at most 20 carbon atoms. Preferred substituents include a halogen atom, a nitro group, an alkyl group having at most 12 carbon atoms, an alkoxy group having at most 12 carbon atoms, an aryloxy group having at most 12 carbon atoms, an alkylamino group having at most 12 carbon atoms, a dialkylamino group having at most 12 carbon atoms, an arylamino group having at most 12 carbon atoms, and a diarylamino group having at most 12 carbon atoms. $Z^{21-}$ has the same meaning as $Z^{11-}$, representing a counter ion.

In formula (V), $R^{31}$, $R^{32}$ and $R^{33}$ may be the same or different, and each represents an optionally-substituted hydrocarbon group having at most 20 carbon atoms. Preferred substituents for them are a halogen atom, a nitro group, an alkyl group having at most 12 carbon atoms, an alkoxy group having at most 12 carbon atoms, and an aryloxy group having at most 12 carbon atoms. $Z^{31-}$ has the same meaning as $Z^{11-}$, representing a counter ion.

Hereinunder shown are specific examples of preferred onium salts for use in the present invention, those of formula (III) are [OI-1] to [OI-10], those of formula (IV) are [ON-1] to [ON-5], and those of formula (V) are [OS-1] to [OS-6].

[OI-1]

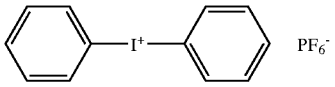

[OI-2]

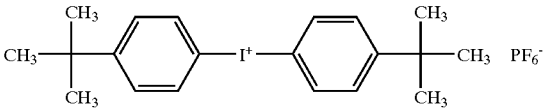

[OI-3]

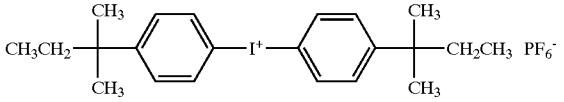

[OI-4]

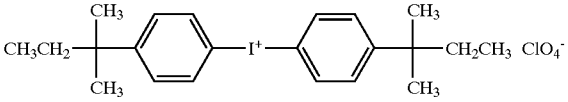

[OI-5]

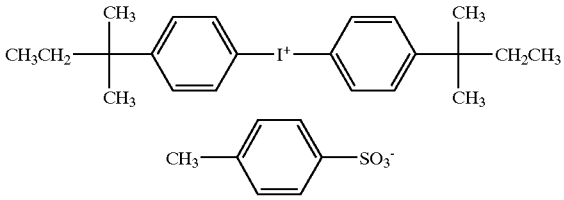

[OI-6]

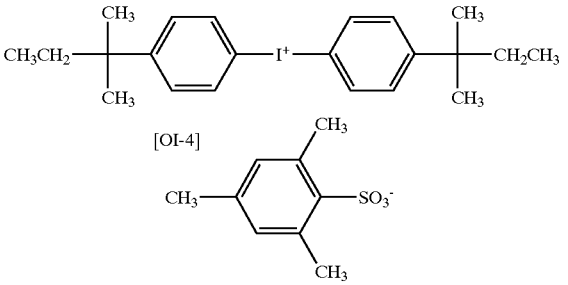

[OI-7]

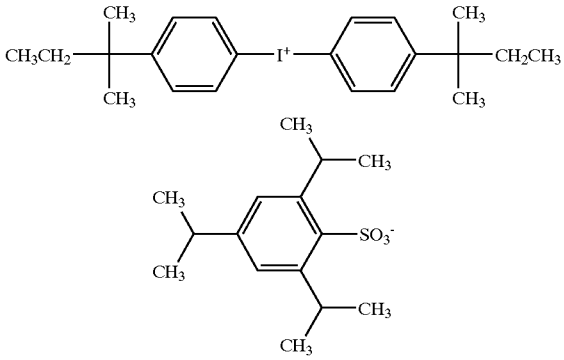

[OI-8]

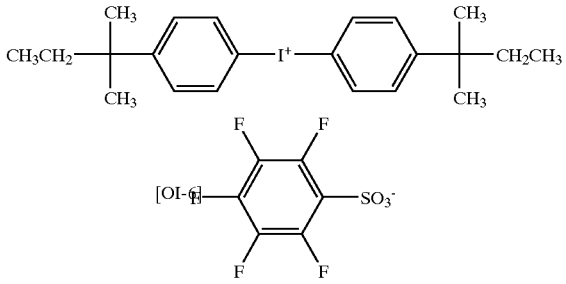

[OI-9]

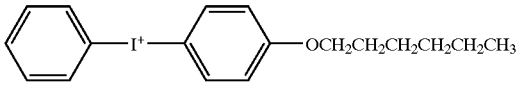

[OI-10]

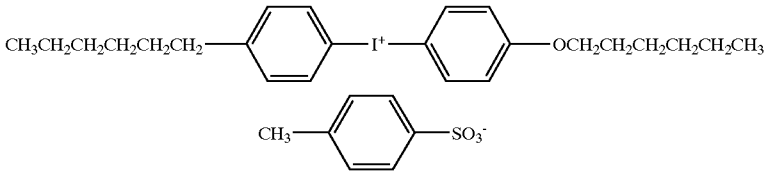

-continued
[ON-1]
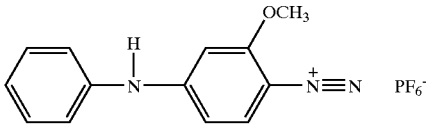
[ON-2]
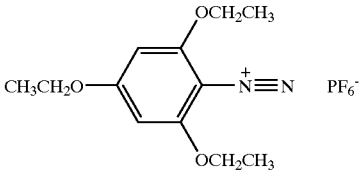
[ON-3]
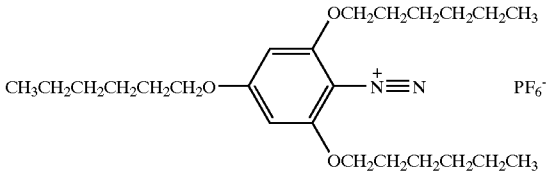
[ON-4]
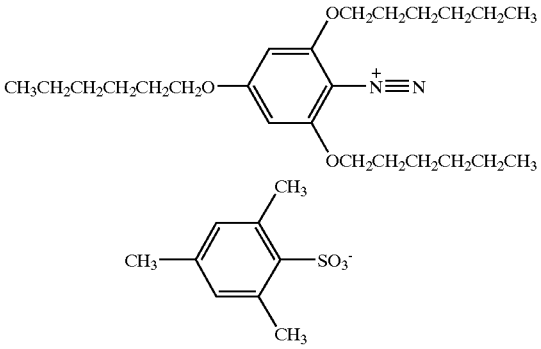
[ON-5]
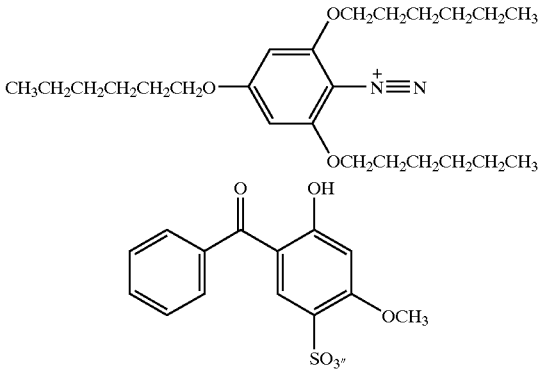
[OS-1]
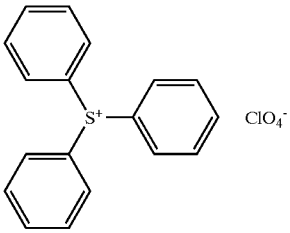
[OS-2]
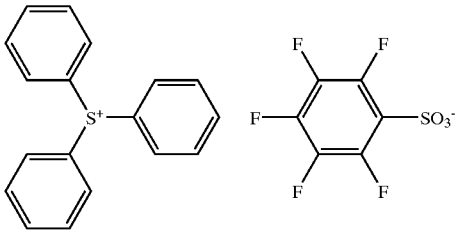
[OS-3]
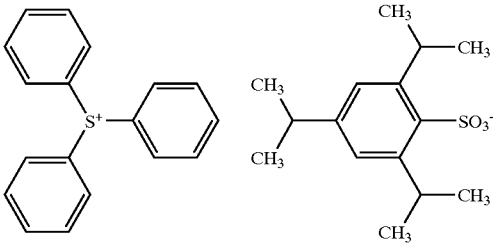
[OS-4]
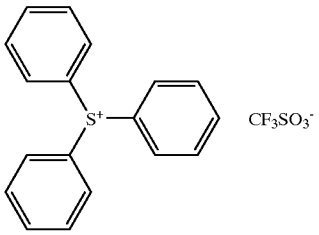
[OS-5]
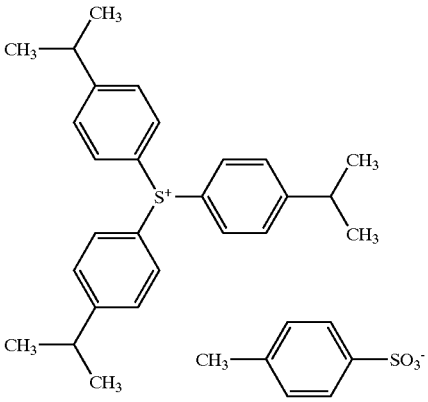

-continued

[OS-6]

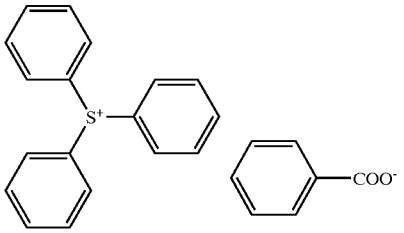

Additionally, onium salts described in paragraphs [0030] to [0037] in Japanese Patent Application No. 2000-184603 are also preferably used in the present invention.

Preferably, an onium salt in the present invention has a peak absorption wavelength of not longer than 400 nm, more preferably not longer than 360 nm. Because the onium salt has the absorption wavelength in the UV range, the image-recording material of the present invention can be handled and processed even under white light.

The onium salt may be in the image-recording material in an amount of from 0.1 to 50% by weight, preferably from 0.5 to 30% by weight, more preferably from 1 to 20% by weight of the total solid content of the material. If the amount of the onium salt is smaller than 0.1% by weight, the sensitivity of the recording material will be low; but if larger than 50% by weight, the non-image area of a printing plate having a layer of the material will be stained. One or more such onium salts may be in the recording material either singly or combined. If desired, the onium salt may be added to the same photosensitive layer of the material as other components; or may be in a separate layer, which may be applied with a layer containing the other components.

(C) Radical-polymerizing Compound

The radical-polymerizing compound in the image-recording material of the present invention has at least one ethylenically unsaturated double bond, and is selected from compounds having at least one, preferably at least two terminal ethylenically unsaturated bonds. These compounds are well known in the art, and any of them are usable herein with no specific limitation. They have various chemical forms, including, for example, monomers, prepolymers (e.g., dimers, trimers and oligomers), and mixtures and copolymers thereof and the like. Examples of monomers and copolymers thereof are unsaturated carboxylic acids (e.g., acrylic acid, methacrylic acid, itaconic acid, crotonic acid, isocrotonic acid, maleic acid and the like), and esters and amides thereof. Preferred are esters of unsaturated carboxylic acids and aliphatic polyalcohols; and amides of unsaturated carboxylic acids and aliphatic polyamines. Also preferred are adducts of unsaturated carboxylates or amides having a nucleophilic substituent of, for example, a hydroxyl, amino or mercapto group, with monofunctional or polyfunctional isocyanates or epoxides; and dehydrated condensates thereof with monofunctional or polyfunctional carboxylic acids. Also preferred are adducts of unsaturated carboxylates or amides having an electrophilic substituent of, for example, an isocyanate or epoxy group, with monofunctional or polyfunctional alcohols, amines or thiols; and substituting reaction products of unsaturated carboxylates or amides having a leaving substituent of, for example, a halogen or a tosyloxy group, with monofunctional or polyfunctional alcohols, amines or thiols. Also usable herein are other groups of compounds, for which unsaturated phosphonic acids or styrenes are used in place of the unsaturated carboxylic acids.

Specific examples of esters of aliphatic polyalcohols and unsaturated carboxylic acids for use as the radical-polymerizing compound are mentioned below. Acrylates include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl) ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri (acryloyloxyethyl) isocyanurate, polyester acrylate oligomers and the like.

Methacrylates include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)phenyl]dimethylmethane, bis-[p-(methacryloxyethoxy)phenyl]dimethylmethane and the like.

Itaconates include ethylene glycol diitaconate, propylene glycol diitaconate, 1,3-butanediol diitaconate, 1,4-butanediol diitaconate, tetramethylene glycol diitaconate, pentaerythritol diitaconate, sorbitol tetraitaconate and the like.

Crotonates include ethylene glycol dicrotonate, tetramethylene glycol dicrotonate, pentaerythritol dicrotonate, sorbitol tetracrotonate and the like.

Isocrotonates include ethylene glycol diisocrotonate, pentaerythritol diisocrotonate, sorbitol tetraisocrotonate and the like.

Maleates include ethylene glycol dimaleate, triethylene glycol dimaleate, pentaerythritol dimaleate, sorbitol tetramaleate and the like.

Other esters also preferred for use herein are, for example, aliphatic alcohol esters such as those described in JP-B Nos. 46-27926 and 51-47334, and JP-A No. 57-196231; aromatic esters as in JP-A Nos. 59-5240, 59-5241 and 2-226149; and amino-having esters as in JP-A No. 1-165613.

Specific examples of amide monomers of aliphatic polyamines and unsaturated carboxylic acids preferred for use herein are methylenebis-acrylamide, methylenebis-methacrylamide, 1,6-hexamethylenebis-acrylamide, 1,6-hexamethylenebis-methacrylamide, diethylenetriamine-trisacrylamide, xylylenebis-acrylamide, xylylenebis-methacrylamide and the like.

Other amide monomers also preferred for use herein are those having a cyclohexylene structure, as in JP-B No. 54-21726.

Also preferred are urethane polyadducts obtained through addition reaction of isocyanates with hydroxyl compounds. Specific examples are vinylurethanes having at least two polymerizing vinyl groups in one molecule, which are produced through addition reaction of polyisocyanate compounds having at least two isocyanate groups in one molecule with hydroxyl-having vinyl monomers of the following formula (VI) and the like, for example, as in JP-B No. 48-41708.

$$CH_2{=}C(R^{41})COOCH_2CH(R^{42})OH \qquad \text{General formula (VI)}$$

wherein $R^{41}$ and $R^{42}$ each represents H or CH3.

Also preferred for use herein are urethane acrylates such as those described in JP-A No. 51-37193, and JP-B Nos. 2-32293 and 2-16765; and ethylene oxide skeleton-having urethane compounds as in JP-B Nos. 58-49860, 56-17654, 62-39417 and 62-39418.

Also usable herein are radical-polymerizing compounds having an amino structure or sulfido structure in the molecule, such as those described in JP-A Nos. 63-277653, 63-260909 and 1-105238.

Other examples usable herein are polyfunctional acrylates and methacrylates such as polyester acrylates, and epoxy acrylates produced through reaction of epoxy resins with (meth)acrylic acids, for example, as in JP-A No. 48-64183, and JP-B Nos. 49-43191 and 52-30490. Also usable are specific unsaturated compounds, as in JP-B Nos. 46-43946, 1-40337 and 1-40336; and vinylphosphonic acids, as in JP-A No. 2-25493. As the case may be, preferred are perfluoroalkyl-having compounds such as those described in JP-A No. 61-22048. Also usable herein are photo-curable monomers and oligomers disclosed in *Journal of the Adhesive Association of Japan*, Vol. 20, No. 7. pp. 300–308 (1984).

Details of the use of these radical-polymerizing compounds in the present invention, including what type of compound is used, whether the compounds are used singly or combined, and how much of the compound is added to the recording material, may be freely determined in accordance with the performance requirements of the ultimate recording material of the present invention. For example, the compounds may be selected in view of the following points. With respect to the sensitivity of the recording material, preferred are radical-polymerizing compounds having more unsaturated groups in one molecule. In many cases, preferred are polyfunctional compounds that are at least difunctional. On the other hand, in order to increase the mechanical strength of the image area, that is, the mechanical strength of the cured film of the material, preferred are polyfunctional compounds that are at least trifunctional. Combining various radical-polymerizing compounds that differ in the number of functional groups therein and in the type of polymerizing groups therein (for example, acrylates, methacrylates, styrenes and the like) is effective for enhancing both the sensitivity of the recording material and the mechanical strength of the image area of the film of the material. Compounds having a large molecular weight and compounds having a high degree of hydrophobicity ensure high sensitivity and high film strength, but are often undesirable as they might not be well processed at high development speed and as they often deposit in developers. Selection and use of radical-polymerizing compounds in the present invention is a matter of great importance in view of their compatibility and dispersibility with the other components of the photosensitive layer of the recording material of the present invention (e.g., binder polymers, polymerization initiators and colorants). For example, using low-purity compounds or combining two or more different compounds may improve the compatibility of the compounds with the other components. As the case may be, compounds having a specific structure can be selected for improving adhesiveness of the recording material to a support or overcoat layer. In general, the blend ratio of the radical-polymerizing compound in the recording layer of the image-recording material is preferably larger for higher sensitivity of the image-recording layer. However, if the blend ratio is too large, there may be problems in that unfavorable phase separation may occur in the coating liquid of the material, the image-recording layer of the material may be sticky and interfere with smooth production of products (for example, the components of the recording layer are transferred and adhere to unintended areas), and deposits may be formed in a developer solution. In view of these points, the preferred blend ratio of the radical-polymerizing material in the recording material of the present invention is generally from 5 to 80% by weight, more preferably between 20 and 75% by weight of all the components of the material. One or more different radical-polymerizing compounds may be in the material either singly or combined. Regarding a method of using the radical-polymerizing compounds in the material, the structure, the blend ratio and the amount of the compounds to be in the material may be suitably selected depending on a degree of polymerization retardation of the compounds by oxygen, resolution of the recording layer containing the compound, fogging resistance, a refractive index change, surface adhesiveness and the like. As the case may be, subbing layers or over-coat layers may be disposed on or below the recording layer in any desired manner.

(D) Reducing Additive

The reducing additive in the image-recording material of the present invention is not specifically limited as long as it reacts with the radical derived from the onium salt that serves as the radical generator (B) in the material, and forms a strong electron donor. Preferably, the reducing additive is highly reactive with radicals and a reaction product with a radical has high reductivity. Specifically, it is desirable that the reducing additive has a reaction rate constant with respect to radicals of at least $1\times10^5$ $M^{-1}sec^{-1}$, more preferably at least $1\times10^6$ $M^{-1}$ $sec^{-1}$. Also, preferably, the reaction rate constant with respect to onium salts of the electron donor formed through radical reaction is at least $1\times10^6$ $M^{-1}sec^{-1}$, more preferably at least $1\times10^7$ $M^{-1}sec^{-1}$. Further preferably, the oxidation potential of the electron donor is −0.3 V (vs. SCE) or less, more preferably −0.5 V (vs. SCE) or less.

In view of the above, preferred compounds of the reducing additive for use in the present invention are ether-type hydrogen donors, alcohol-type hydrogen donors, vinyl ethers, and phosphine-type compounds. For forming an image, the image-recording material of the present invention is subjected to heat-mode exposure, and the light-to-heat converting agent in the material generates a large amount of heat while the material is being exposed. Therefore, compounds capable of functioning as a reducing additive after having been pyrolyzed through such heat-mode exposure of the recording material are also usable in the present invention.

As ether-type hydrogen donors, preferred are cyclic ether compounds of the following general formulae (i) and (ii), and polyethers of the following formula (iii).

(i)

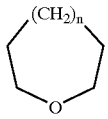

(ii)

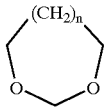

(iii)

$R^2—(R^1—O)_m—R^3$

In these formulae, n indicates 0, 1 or 2; m indicates an integer of at least 2; $R^1$ represents a divalent alkylene group; and $R^2$ and $R^3$ each represents a monovalent organic group.

Preferred examples of ether-type hydrogen donors for use in the present invention are the following compounds (M-1) to (M-22), to which, however, the present invention is not limited.

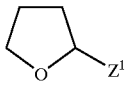

$Z^1$ = —H (M-1)

—$CH_3$ (M-2)

—$CH_2OCH_3$ (M-3)

—$OCH_2CH_3$ (M-4)

—$CH_2OH$ (M-5)

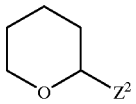

$Z^2$ = —H (M-6)

—$OCH_3$ (M-7)

—$CH_2Cl$ (M-8)

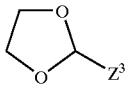

$Z^3$ = —H (M-9)

—$OCH_2CH_2OCH_2CH_2OCH_3$ (M-10)

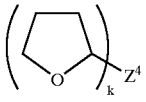

-continued k = 2, $Z^4$ = —$CH_2OCO(CH_2)_4CO_2CH_2$— (M-11)

k = 2, $Z^4$ = —$CH_2OCO$— 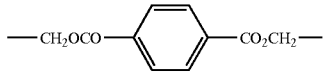 —$CO_2CH_2$— (M-12)

k = 2, $Z^4$ = —$CH_2O(CH_2)_4OCH_2$— (M-13)

k = 2, $Z^4$ = —$CH_2OCONH(CH_2)_6NHCO_2CH_2$— (M-14)

k = 3, $Z^4$ = 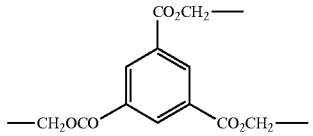 (M-15)

(M-16)

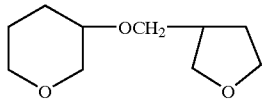

(M-17)

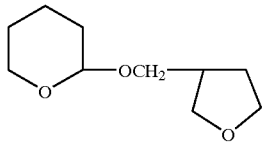

(M-18)

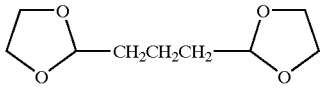

$CH_3(OCH_2CH_2)_kOCH_3$ k = 3 (M-19)

k = 4 (M-20)

$H(OCH_2CH_2)_kOH$ k = integer of at least 1 (M-21)

$H(OCH(CH_3)CH_2)_kOH$ k = integer of at least 1 (M-22)

As alcohol-type hydrogen donors, preferred are secondary alcohols of the following formula (iv).

(iv)

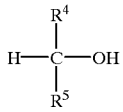

wherein $R^4$ and $R^5$ each represents a monovalent or divalent organic group.

Preferred examples of alcohol-type hydrogen donors for use herein are the following compounds (M-23) to (M-34), to which, however, the present invention is not limited.

(M-23)

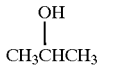

(M-24)

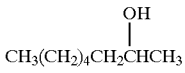

-continued (M-25)

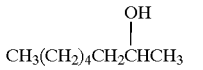

(M-26)

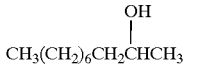

(M-27)

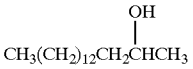

(M-28)

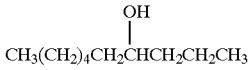

(M-29)

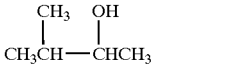

(M-30)

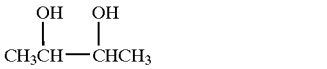

(M-31)

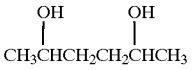

(M-32)

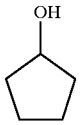

(M-33)

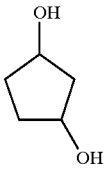

(M-34)

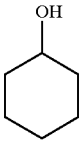

As vinyl ethers, preferred are those of the following formula (v).

(v)

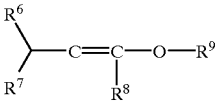

wherein $R^6$ to $R^9$ each independently represents a monovalent or divalent organic group.

Preferred examples of vinyl ethers for use in the present invention are the following compounds (M-35) to (M-44), to which, however, the present invention is not limited.

(M-35)

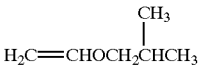

(M-36)

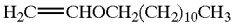

-continued (M-37)

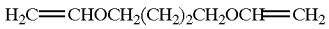

(M-38)

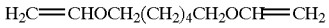

(M-39)

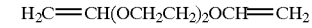

(M-40)

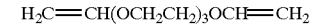

(M-41)

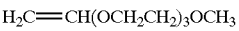

(M-42)

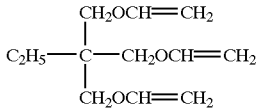

(M-43)

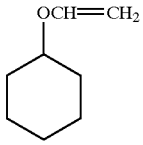

(M-44)

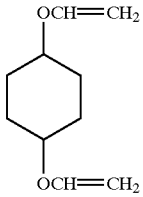

As phosphines, preferred are those of the following formula (vi) or (vii).

(vi)

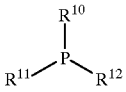

(vii)

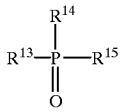

wherein $R^{10}$ to $R^{15}$ each independently represents a monovalent or divalent organic group.

Preferred examples of phosphines for use in the present invention are the following compounds (M-45) to (M-55), to which, however, the present invention is not limited.

(M-45)

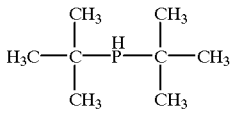

(M-46)

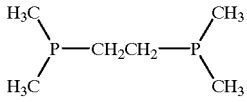

-continued (M-47)

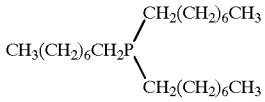

(M-48)

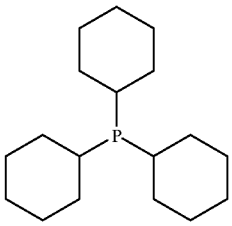

(M-49)

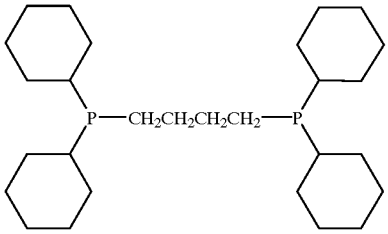

(M-50)

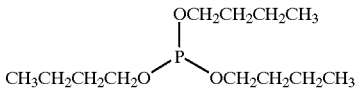

(M-51)

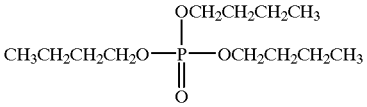

(M-52)

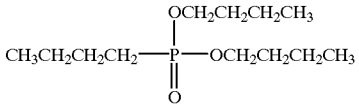

(M-53)

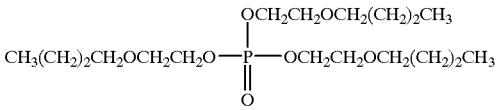

(M-54)

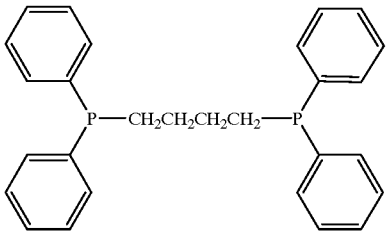

-continued (M-55)

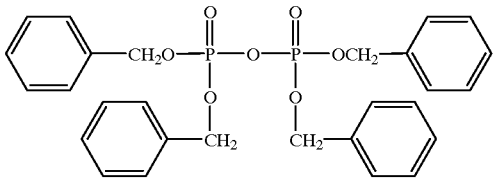

Other compounds capable of functioning as a reducing additive, after having been pyrolyzed, are also usable as the reducing additive (D) in the image-recording material of the present invention, and examples thereof include the following compounds (M-56) to (M-60), to which, however, the present invention is not limited.

(M-56)

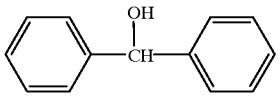

(M-57)

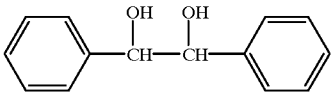

(M-58)

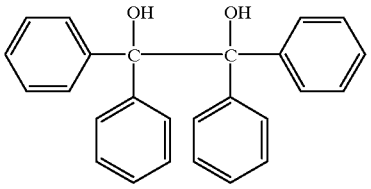

(M-59)

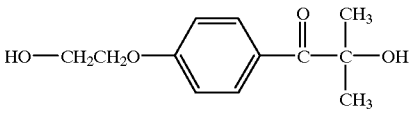

(M-60)

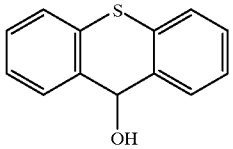

One or more different compounds serving as the reducing additive (D) may be in the recording material of the present invention separately or combined.

The amount of the reducing additive (D) in the recording material may be from 0.1 to 70% by weight, preferably between 0.5 and 50% by weight, and more preferably between 1 and 30% by weight of the total solid content of the material. If the amount is smaller than 0.1% by weight, the effect of the reducing additive to improve the printing durability of the recording layer of the material will be low, that is, the reducing additive in the material will be ineffective. On the other hand, if the amount of the reducing additive in the recording material is larger than 70% by weight, the non-image area of the recording layer of the material will be stained, and the film properties of the layer before and after curing will be worsened.

Binder Polymer

The image-recording material of the present invention may contain a binder polymer for improving film characteristics of the recording layer of the material. As the binder, preferred are linear organic polymers. A linear organic polymer for use in the present invention may be any known linear organic polymer. Preferred are those soluble or swellable in water or weakly alkaline water, for enabling development of the material with water or weakly alkaline water. The linear organic polymer serving as a film-forming agent in the image-recording material may be selected depending on the mode of development of the material with one of water, weak alkaline water or a solvent developer. For example, if a water-soluble organic polymer is used, the recording material can be developed with water. The linear organic polymers may be radical polymers having a carboxylic acid group in the side branches, such as those described in JP-A No. 59-44615, JP-B Nos. 54-34327, 58-12577 and 54-25957, and JP-A Nos. 54-92723, 59-53836 and 59-71048. These include, for example, methacrylic acid copolymers, acrylic acid copolymers, itaconic acid copolymers, crotonic acid copolymers, maleic acid copolymers, and partial esters of maleic acid copolymers. In addition to these, also usable herein are acid cellulose derivatives having a carboxylic acid group in the side branches, as well as hydroxyl-having polymer adducts with cyclic acid anhydrides.

Of these, especially preferred are (meth)acrylic resins having both a benzyl or allyl group and a carboxyl group in the side branches, due to ensuring good balance of the film strength, the sensitivity and the developability of the image-recording material.

Also preferred are urethane-type binder polymers having an acid group, such as those described in JP-B Nos. 7-12004, 7-120041, 7-120042 and 8-12424, JP-A Nos. 63-287944, 63-287947 and 1-271741, and Japanese Patent Application No. 10-116232, due to ensuring extremely high strength of the image-recording layer of the material, and therefore ensuring good printing durability of the processed material and good low-exposure latitude in processing the material.

In addition, polyvinyl pyrrolidone, ethylene oxide and the like are also preferred for water-soluble linear organic polymers for use herein. Also preferred are alcohol-soluble nylons and polyethers of 2,2-bis(4-hydroxyphenyl)propane and epichlorohydrin, for increasing the mechanical strength of the cured film of the recording material.

Preferably, the polymer used in the present invention has a weight-average molecular weight of at least 5,000, more preferably from 10,000 to 300,000, and a number-average molecular weight of at least 1,000, more preferably from 2,000 to 250,000. Also, the polymer preferably has a molecular weight distribution (weight-average molecular weight/number-average molecular weight) of at least 1, more preferably from 1.1 to 10.

The polymer may be any of random polymers, block polymers and graft polymers, but is preferably a random polymer.

The polymer for use in the present invention may be synthesized by any known method. Solvents usable in synthesis include, for example, tetrahydrofuran, ethylene dichloride, cyclohexanone, methyl ethyl ketone, acetone, methanol, ethanol, ethylene glycol monomethyl ether, ethylene glycol monoethyl ether, 2-methoxyethyl acetate, diethylene glycol dimethyl ether, 1-methoxy-2-propanol, 1-methoxy-2-propyl acetate, N,N-dimethylformamide, N,N-dimethylacetamide, toluene, ethyl acetate, methyl lactate, ethyl lactate, dimethylsulfoxide, and water. One or more of these solvents may be used either singly or as combined.

A radical polymerization initiator usable for synthesizing the polymer may be any known compound, including, for example, azo-type initiators, and peroxide initiators.

In producing the image-recording material of the present invention, one or more binder polymers may be added thereto either singly or combined. Preferably, the amount of polymer to be added to the material is from 20 to 95% by weight, more preferably between 30 and 90% by weight of total solid content of the material. If the amount is smaller than 20% by weight, adding the polymer will be ineffective for increasing mechanical strength of the image area of the film of the processed material; but if larger than 95% by weight, no image will be formed on the material. Also, preferably, the ratio of the binder polymer, that is, the linear organic polymer, to the radical-polymerizable ethylenically unsaturated double bond-having compound, which is essential component (C) in the recording material, is from 1/9 to 7/3 by weight.

Other Components

In addition to the components mentioned above, various compounds may be optionally added to the image-recording material of the present invention. For example, dyes having a great absorption in the visible light range may be added thereto, serving as colorants for images. Specifically, the dyes are Oil Yellow #101, Oil Yellow #103, Oil Pink #312, Oil Green BG, Oil Blue BOS, Oil Blue #603, Oil Black BY, Oil Black BS, Oil Black T-505 (these are products of Orient Chemical); Victoria Pure Blue, Crystal Violet (CI 42555), Methyl Violet (CI 42535), Ethyl Violet, Rhodamine B (CI 145170B), Malachite Green (CI 42000), Methylene Blue (CI 52015), dyes described in JP-A No. 62-293247, and the like. Pigments such as phthalocyanine pigments, azo pigments, carbon black and titanium oxide are also preferred as colorants for the recording material.

Adding the colorant to the image-recording material is preferred, due to facilitating differentiation of the image area from the non-image area in the layer of the processed material. The amount of the colorant in the material may fall between 0.01 and 10% by weight of the total solid content of the material.

Preferably, a small amount of a thermal polymerization inhibitor is added to the image-recording material for preventing unnecessary thermal polymerization of the radical-polymerizable, ethylenically unsaturated double bond-having compound in the material while the material is being produced or stored. Examples of the thermal polymerization inhibitor are hydroquinone, p-methoxyphenol, di-t-butyl-p-cresol, pyrogallol, t-butylcatechol, benzoquinone, 4,4'-thiobis(3-methyl-6-t-butylphenol), 2,2'-methylenebis(4-methyl-6-t-butylphenol), and N-nitroso-N-phenylhydroxylamifle aluminum salt and the like. Preferably, the amount of the thermal polymerization inhibitor in the material falls between about 0.01% by weight and about 5% by weight of the material. If desired, a higher fatty acid or derivative thereof, such as behenic acid or behenic acid amide, having the ability to prevent polymerization retardation by oxygen may be added to the recording material. In a step of drying the material after coating on a support, the acid or acid derivative added to the material may be localized in the surface of the photosensitive layer of the material formed on the support. Preferably, the amount of the higher fatty acid or derivative in the recording material falls between about 0.1% by weight and about 10% by weight of the material.

Also, the image-recording material of the present invention may contain a nonionic surfactant, as in JP-A Nos. 62-251740 and 3-208514, or an ampholytic surfactant as in JP-A Nos. 59-121044 and 4-13149, for further ensuring stable development of the material in various conditions.

Specific examples of the nonionic surfactant are sorbitan tristearate, sorbitan monopalmitate, sorbitan trioleate, stearic acid monoglyceride, polyoxyethylene nonylphenyl ether and the like.

Specific examples of the ampholytic surfactant are alkyl-di(aminoethyl)glycines, alkyl-polyaminoethylglycine hydrochlorides, 2-alkyl-N-carboxyethyl-N-hydroxyethylimidazolium betaines, N-tetradecyl-N,N-betaines (e.g., AMOGEN K manufactured by Dai-ichi Kogyo) and the like.

The amount of the nonionic surfactant or ampholytic surfactant in the image-recording material preferably falls between 0.05 and 15% by weight, more preferably between 0.1 and 5% by weight of the material.

Also, if desired, the image-recording material of the present invention may contain a plasticizer for softening the film of the material. The plasticizer includes, for example, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate or the like.

In general, the above-mentioned components of the image-recording material of the present invention are dissolved in a solvent and applied to a suitable support. The solvent includes, for example, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetainide, N,N-dimethylformamide, tetramethylurea, N-methylpyrrolidOfle, dimethylsulfoxide, sulfolane, g-butyrolactone, toluene, water or the like, but is not limited thereto. These solvents may be used singly or combined. Preferably, the concentration of the constituent components (in terms of total solid content including additives) in the solvent falls between 1 and 50% by weight.

The amount (in terms of solid content of the material) of the layer formed and dried on the support varies depending on the use of the material, but in general is preferably between 0.5 and 5.0 g/m$^2$ for lithographic printing plates. For applying the coating liquid of the material to supports, various coating methods can be employed. For example, employable are any of bar coating, spin coating, spraying, curtain coating, dipping, air-knife coating, blade coating, and roll coating. With a decrease in the amount of the material coated, the apparent sensitivity of the image-recording layer formed increases, but the film characteristics of the layer decrease.

For improving the coatability of the image-recording material of the present invention, a surfactant, for example, a fluorine-containing surfactant as in JP-A No. 62-170950 may be added to the material. Preferably, the amount of the surfactant to be added falls between 0.01 and 1% by weight, and more preferably between 0.05 and 0.5% by weight of the total content of the material.

Protective Layer

In a lithographic printing plate whose photosensitive layer is formed of the negative image-recording material of the present invention, a protective layer may be provided on the photosensitive layer, if desired. The lithographic printing plate of this type is generally exposed to light in air. The protective layer formed on the photosensitive layer acts to prevent low-molecular compounds such as oxygen and basic substances from entering the photosensitive layer (these low-molecular compounds are present in air and retard image formation in the photosensitive layer exposed to light in air), and thereby protects the photosensitive layer from such low-molecular compounds. Accordingly, the necessary characteristic of the protective layer is that oxygen and other low-molecular compounds do not permeate through the layer. In addition, it is desirable that the light transmission through the layer is high, the adhesiveness of the layer to the underlying photosensitive layer is good, and the protective layer is readily removed through development after exposure.

Various protective layers have heretofore been suggested, for example, as described in detail in U.S. Pat. No. 3,458,311 and JP-A No. 55-49729. For a material for the protective layer preferred is, for example, a water-soluble polymer compound having a relatively high degree of crystallinity. Specifically known are water-soluble polymers such as polyvinyl alcohol, polyvinyl pyrrolidone, acetic cellulose, gelatin, gum arabic, and polyacrylic acid. Of those, polyvinyl alcohol is preferred as a main component of the protective layer, due to providing the best results for basic characteristics of a layer that blocks out oxygen and is readily removable through development. Polyvinyl alcohol for the protective layer may be partially esterified, etherified and/or acetallized as long as it has unsubstituted vinyl alcohol units, which are necessary for its oxygen barrier property and for its solubility in water. Also, if desired, a part thereof may have another copolymer component.

For example, polyvinyl alcohol hydrolyzed to a degree of from 71 to 100% and having a molecular weight of from 300 to 2,400 may be used for the protective layer. Specific examples of polyvinyl alcohol of this type are Kuraray's PVA-105, PVA-110, PVA-117, PVA-117H, PVA-120, PVA-124, PVA-124H, PVA-CS, PVA-CST, PVA-HC, PVA-203, PVA-204, PVA-205, PVA-210, PVA-217, PVA-220, PVA-224, PVA-217EE, PVA-217E, PVA-220E, PVA-224E, PVA-405, PVA-420, PVA-613 and L-8 and the like.

The constituent components of the protective layer (e.g., the type of PVA to be used, the presence or absence of additives in the layer), and the amount forming the layer should be determined in consideration of the oxygen barrier property of the layer, the removability of the layer through development, and also fogging resistance, adhesiveness and scratch resistance of the layer. In general, it is desirable that PVA hydrolyzed to a higher degree (PVA in which unsubstituted vinyl alcohol units are higher in number) is used to form a thicker protective layer, as the oxygen barrier property of the layer will be better and the sensitivity will be higher. However, it is often problematic if the ability of the protective layer to block out oxygen is enhanced too much, in that some unnecessary polymerization will occur in the photosensitive recording layer while photographic materials comprising the layer are produced or are stored before processing, and that, when imagewise exposed, the layer will be undesirably fogged or an image line formed in exposure will be thickened. In addition, the adhesiveness of the protective layer to the image area of the processed photosensitive layer and the scratch resistance of the protective layer are also extremely important in handling the printing plates. Specifically, when a hydrophilic layer of a water-soluble polymer (the protective layer of this case) is laminated over an oleophilic polymerizing layer (the photosensitive recording layer), the hydrophilic polymer layer tends to peel off from the oleophilic polymerizing layer as adhesiveness between the two is low. In this case, the part of the oleophilic polymerizing layer (photosensitive recording layer) from which the hydrophilic polymer layer (protective layer) has been peeled will not be well polymerized owing to oxygen penetration thereinto, and will therefore involve a defect of curing failure.

To solve this problem, that is, to improve the adhesiveness between the two layers, various proposals have heretofore been made. For example, in U.S. Pat. No. 4,072,527, from 20 to 60% by weight of an acrylic emulsion or a water-insoluble vinyl pyrrolidone-vinyl acetate copolymer is added to a hydrophilic polymer essentially of polyvinyl alcohol, and a layer of the resulting mixture is laminated over a polymerizing layer to ensure good adhesiveness between the two layers. Any known technique, such as that disclosed in these US patent specifications, may be applied to the protective layer in the present invention. Methods of forming the protective layer in such a known manner are described in detail in, for example, U.S. Pat. No. 3,458,311 and JP-A No. 55-49729.

Further, the protective layer may be modified to provide additional functions. For example, a colorant (e.g., a water-soluble dye) capable of transmitting light for exposure (for example, IR radiation in a wavelength range of about from 760 to 1200 nm for the image-recording material of the present invention) and capable of efficiently absorbing other light, which does not participate in exposure, may be added to the protective layer to thereby further broaden safe light latitude of the photographic material having the protective layer, while not lowering the sensitivity.

Support

One example of a support to which the image-recording material of the present invention may be applied is a tabular support having good dimensional stability, for example, paper, paper laminated with a plastic material (e.g., polyethylene, polypropylene or polystyrene), metal sheets (of, for example, aluminum, zinc or copper), plastic films (of, for example, cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, or polyvinyl acetal), or paper or plastic films coated with metal, such as the metals mentioned above, through lamination or deposition.

As the support of the image-forming material of the present invention, preferred are polyester films and aluminum sheets. Above all, especially preferred are aluminum sheets, due to having good dimensional stability and being relatively inexpensive. Preferably, the aluminum sheet is a pure aluminum sheet or an a aluminum alloy consisting mainly of aluminum, and containing traces of hetero elements. Aluminum-laminated or deposited plastic films are also usable herein. The hetero elements in the aluminum alloy include, for example, silicon, iron, manganese, copper, magnesium, chromium, zinc, bismuth, nickel and titanium. The hetero element content of the aluminum alloy is at most 10% by weight. Especially preferred for use in the present invention are pure aluminum sheets. However, completely pure aluminum is difficult to prepare with an ordinary smelting technique. Therefore, the pure aluminum for use herein may contain traces of hetero elements. The aluminum sheets for use in the present invention are not specifically defined with regard to composition, and any known aluminum sheets which have been used in the art may be used in the present invention. The thickness of the aluminum sheet may be from 0.1 mm to 0.6 mm or so, preferably between 0.15 mm and 0.4 mm, and more preferably between 0.2 mm and 0.3 mm.

Prior to roughening, if desired, the surface of the aluminium aluminum sheet may be degreased, for example, by treatment with a surfactant, an organic solvent or an aqueous alkali solution, for removing rolling oil.

The surface of the aluminum sheet may be roughened by various methods. For example, it may be mechanically roughened, or may be roughened through electrochemical surface dissolution or through selective chemical dissolution. For mechanical roughening, any known method is employable. For example, the surface of the aluminum sheet may be roughened by ball grinding, brushing, blasting, or buffing. For electrochemical roughening, for example, the aluminum, sheet may be processed in an electrolytic solution of hydrochloric acid or nitric acid with a direct current or an alternating current being applied. These two methods may be combined, as in JP-A No. 54-63902.

If desired, the thus-roughened aluminum sheet may be etched with alkali and neutralized, and then optionally subjected to anodic oxidation for further enhancing water retentiveness and abrasion resistance of the surface. For anodic oxidation of the aluminum sheet, employable are various types of electrolytes capable of forming porous oxide films. Generally employed is sulfuric acid, phosphoric acid, oxalic acid, chromic acid or a mixture thereof. The concentration of the electrolyte for anoxic oxidation may be determined depending on the type of the electrolyte used.

The conditions for anodic oxidation vary, depending on the type of the electrolyte used, and therefore cannot be specified for all cases. In general, however, electrolyte concentration of the processing solution may be between 1 and 80% by weight; temperature of the processing solution may be between 5 and 70° C.; current density may be between 5 and 60 A/dm$^2$; voltage may be between 1 and 100 V; and the time for electrolysis may be between 10 seconds and 5 minutes.

The amount of the oxide film to be formed through such anodic oxidation is preferably at least 1.0 g/m$^2$. If the amount is less, desired printing durability will be unsatisfactory, and the non-image area of the lithographic printing plate will be readily scratched. After scratching, ink will adhere to the scratches and obtained prints will often be stained.

After having been subjected to anodic oxidation, the surface of the aluminum sheet is optionally hydrophilicated. For hydrophilication, employable is, for example, a method of processing the aluminum sheet with an alkali metal silicate (e.g., aqueous sodium silicate solution), as in U.S. Pat. Nos. 2,714,066, 3,181,461, 3,280,734 and 3,902,734. In this method, the support is dipped in an aqueous sodium silicate solution or is electrolyzed in the solution. Apart from this method, also employable is a method of processing the aluminum sheet with potassium fluorozirconate, as in JP-B No. 36-22063; or a method of processing with polyvinylphosphonic acid, as in U.S. Pat. Nos. 3,276,868, 4,153,461 and 4,689,272.

The image-recording material of the present invention may be applied to a support such as that mentioned hereinabove, to form thereon a recording layer of the material. If desired, a subbing layer may be provided between the recording layer and the support.

Various organic compounds can be used as components of the subbing layer. For example, carboxymethyl cellulose, dextrin, gum arabic; amino group-having phosphonic acids such as 2-amninoethylphosphonic acid; other organic phosphonic acids such as optionally-substituted phenylphosphonic acids, naphthylphosphonic acids, alkylphosphonic acids, glycerophosphonic acids, methylenediphosphonic acids and ethylenediphosphonic acids; organic phosphoric acids such as optionally-substituted phenylphosphoric acid, naphthylphosphoric acid, alkylphosphoric acid and glycerophosphoric acid; organic phosphinic acids such as optionally-substituted phenylphosphinic acid, naphthylphosphinic acid, alkylphosphinic acid and glycerophosphinic acid; amino acids such as glycine and β-alanine; and hydroxyl group-having amine hydrochlorides such as triethanolamine hydrochloride and the like. Two or more of these compounds may be combined as components of the subbing layer.

After the support has been processed and/or coated with a subbing layer as above, a back surface of the support is optionally coated with a back coat layer. For the back coat layer, preferred are organic polymer compounds such as those described in JP-A No. 5-45885; and metal oxides formed by hydrolyzing and polycondensing organic or inorganic metal compounds, such as described in JP-A No. 6-35174. More preferred are silicon alkoxides such as $Si(OCH_3)_4$, $Si(OC_2H_5)_4$, $Si(OC_3H_7)_4$, and $Si(OC_4H_9)_4$, which are inexpensive and easily available. Especially preferred are coating layers of such metal oxides, which are highly resistant to developers.

One preferred characteristic of the support for the lithographic printing plate is that surface roughness thereof is between 0.10 and 1.2 μm in terms of center line average height. If this is lower than 0.10 μm, the adhesiveness between the support and the photosensitive layer formed thereon will be low, and the printing durability of the printing plate will be extremely poor. On the other hand, if the surface roughness of the support is larger than 1.2 μm, the prints formed will often be stained. Color density of the support preferably falls between 0.15 and 0.65 in terms of reflection density. If this is smaller than 0.15, that is, if the support is too white, halation thereon in image exposure will be too strong and good images cannot be formed. On the other hand, if the color density of the support is larger than 0.65, that is, if the support is too dark, the images formed will be difficult to see in a process of image inspection after development, and image inspection efficiency will be greatly lowered.

As described above, the image-recording material of the present invention can be used in producing a lithographic printing plate. An image can be recorded on the printing plate by exposing the photosensitive layer of the plate to IR radiation from an IR laser. As the case may be, image recording thereon may also be effected by exposing the photosensitive layer to a UV lamp or by thermally processing the layer with a thermal head. In the present invention, it is preferable that the photosensitive layer is imagewise exposed to IR radiation within a wavelength range of from 760 nm to 1200 nm from a solid laser or a semiconductor laser. Preferably, the laser output is at least 100 mW, and a multi-beam laser device is used for shortening time for exposure. Also preferably, the exposure time per one pixel is not longer than 20 μsec. Further preferably, the exposure energy to the recording material is between 10 and 300 $mJ/cm^2$.

After having been thus exposed to IR radiation from an IR laser, the image-recording material of the present invention is preferably developed with water or an aqueous alkali solution.

Immediately after having been illuminated with the laser radiation, the photosensitive layer of the material may be directly developed, but is preferably heated between the laser exposure step and the development step. Regarding the heating condition, the exposed layer is preferably heated at a temperature from 80° C. to 150° C. for a period of time from 10 seconds to 5 minutes. The heat treatment, if effected, may reduce the laser energy required for image exposure of the photosensitive layer.

In cases where the image-recording material of the present invention is, after exposure, developed with this aqueous alkaline solution, the developer and a replenisher for development may be any known aqueous alkaline solution. Usable, for example, are inorganic alkali salts such as sodium and potassium silicates, sodium, potassium and ammonium tertiary phosphates, sodium, potassium and ammonium secondary phosphates, sodium, potassium and ammonium carbonates, sodium, potassium and ammonium hydrogencarbonates, sodium, potassium and ammonium borates, and sodium, ammonium, potassium and lithium hydroxides. Also usable are organic alkalis such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, and pyridine.

One or more of these alkalis may be used singly or combined.

In addition, also preferable is an aqueous developer comprising sodium carbonate and an anionic surfactant such as that described in Japanese Patent Application No. 2000-131837.

If an automatic processor is used, it is known that the replenisher, which is the same as the developer originally in the development tank or is an aqueous solution having a higher alkali concentration than the original developer, can replenish the development tank. In the processor of this system, a large number of lithographic printing plates can be continuously processed even if the developer in the development tank is not exchanged for a long period of time. This replenishing system is favorable with the present invention.

If desired, various surfactants and organic solvents may be added to the developer and the replenisher, for promoting or retarding the development, for dispersing developer wastes, and for enhancing affinity of the image area of the developed printing plate to ink. As the surfactant, preferred are anionic, cationic, nonionic and ampholytic surfactants. As the organic solvent, preferred is benzyl alcohol or the like. Also preferred are polyethylene glycol and derivatives thereof, as well as polypropylene glycol and derivatives thereof. If desired, a non-reducing sugar such as arabitol, sorbitol, mannitol or the like may also be added to the developer and the replenisher.

Also, if desired, hydroquinone, resorcinol, or an inorganic salt-type reducing agent such as a sulfite or hydrogensulfite of sodium or potassium, as well as an organic carboxylic acid, a defoaming agent, and a water softener, may be added to the developer and the replenisher.

Developers containing a surfactant, an organic solvent and a reducing agent such as those mentioned above are known. For example, JP-A No. 51-77401 discloses a developer comprising benzyl alcohol, an anionic surfactant, an alkali agent and water; JP-A No. 53-44202 discloses an aqueous developer containing benzyl alcohol, an anionic surfactant and a water-soluble sulfite; and JP-A No. 55-155355 discloses a developer containing an organic solvent, of which the solubility in water at room temperature is at most 10% by weight, an alkali agent and water. These are all favorable to the present invention.

After having been processed with a developer and a replenisher such as those mentioned above, the printing plates are post-processed with washing water, a rinsing solution that contains a surfactant, or a fat-desensitizing solution that contains gum arabic or a starch derivative. In cases where the image-recording material of the present invention is used in producing such printing plates, these post-treatments can be combined in any desired manner.

In recent art of processing printing plates and producing prints, automatic processors for printing plates are widely used for rationalizing and standardizing plate-processing operations. In general, the automatic processor is composed of a developing section and a post-processing section, and includes a unit for conveying printing plates to be processed, and processing solution tanks each equipped with a spraying unit. In these tanks, each exposed plate is conveyed horizontally and sprayed in succession with processing solutions that are pumped through spray nozzles, and is thus developed and processed. Besides this, each exposed plate can be guided in order into tanks filled with respective processing solutions, and guided therein by guide rolls, and thus developed and processed. In such automatic processors, replenishers may be replenished to the respective processing solutions, depending on the processing speed and the processing time. As the case may be, the replenishment may be automated by monitoring the electroconductivity of each processing solution with a sensor.

A processing system with no replenishment thereto is also employable, in which is used a disposable processing solution. In this, printing plates are processed with substantially unused processing solutions, with no replenisher being used.

The lithographic printing plates produced in the above manner are optionally coated with a desensitizing gum, and then used in producing prints. For further enhancing printing durability, they may optionally be baked.

Prior to being baked, it is desirable that the lithographic printing plates are treated with a baking conditioner, for example, as in JP-B Nos. 61-2518 and 55-28062, and JP-A Nos. 62-31859 and 61-159655.

For this, for example, the lithographic printing plates may be wiped with a sponge or absorbent cotton that contains a baking conditioner; or they may be dipped in a baking conditioner in a vat; or a baking conditioner may be applied with an automatic coater. After having been thus coated with the baking conditioner, the plates are preferably squeezed with a squeegee or a squeezing roller so that the plates can be uniformly coated. This treatment produces better results.

The amount of the baking conditioner to be applied to the plates generally falls between 0.03 and 0.8 g/m$^2$ in terms of the dry weight of the baking conditioner.

The lithographic printing plates having been thus coated with the baking conditioner are, after being optionally dried, heated at a high temperature in a baking processor (for example, BP-1300, a baking processor marketed by Fuji Photo Film Co., Ltd.). The heating temperature and heating time in this treatment vary, depending on the image-forming components in the plates. In general, it is desirable that the plates are heated at a temperature between 180 and 300° C., for 1 to 20 minutes.

After having been thus baked, the lithographic printing plates may be washed with water, gummed and the like in a conventional manner as necessary. In cases where the plates are treated with a baking conditioner that contains a water-soluble polymer compound before being baked, a desensitization treatment, for example, the treatment of gumming, may be omitted.

The lithographic printing plate thus produced by this process as above is set in an offset printer and used for producing a large number of prints.

EXAMPLES

The present invention is described in detail with reference to the following Examples, which, however, are not intended to restrict the scope of the present invention.

Examples 1 to 6

Preparation of Support

A melt of JIS A1050 alloy of at least 99.5% Al, containing 0.30% Fe, 0.10% Si, 0.02% Ti and 0.013% Cu was purified and cast. For purifying, the alloy melt was degassed to remove unnecessary gas such as hydrogen therefrom, and filtered through a ceramic tube filter. The alloy melt was cast by DC casting. A solidified ingot having a thickness of 500 mm was cut to a depth of 10 mm from the surface, and then homogenized at 550° C. for 10 hours to prevent intermetallic compounds therein from growing into coarse grains. Next, this was hot-rolled at 400° C., then annealed in a continuous annealing furnace at 500° C. for 60 seconds (process annealing), and thereafter cold-rolled into an aluminum sheet having a thickness of 0.30 mm. Here, the surface roughness of the roll was controlled such that the center line average height, Ra, of the cold-rolled aluminum sheet would be 0.2 $\mu$m. The aluminum sheet was leveled with a tension leveler to thereby further increase surface smoothness.

Next, the aluminium sheet was subjected to surface treatment in the manner mentioned below, so that it could be a support of a lithographic printing plate.

Specifically, for removing rolling oil from the surface, the aluminum sheet was degreased with an aqueous 10% sodium aluminate solution at 50° C. for 30 seconds, then neutralized with aqueous 30% sulfuric acid at 50° C. for 30 seconds, and then desmutted.

Next, the surface of the aluminum sheet was electrolytically dressed and roughened. This was for improving the adhesiveness between the aluminum sheet serving as the support and a photosensitive layer to be formed thereon, and for ensuring water retentiveness of a non-image area of a printing plate having the ammonium sheet as a support. Specifically, an aqueous solution containing 1% nitric acid and 0.5% aluminum nitrate was prepared and kept at 45° C., and a web of the aluminum sheet was passed therethrough while applying an alternating electric current (duty ratio: 1/1) to the solution from an indirect electric cell. The current density was 20 A/dm$^2$; and the electric power to the anode was 240 C/dm$^2$. After having been thus dressed, the aluminum sheet web was etched in an aqueous 10% sodium aluminate solution at 50° C. for 30 seconds, then neutralized in an aqueous 30% sulfuric acid solution at 50° C. for 30 seconds, and thereafter desmutted.

For improving abrasion resistance, chemical resistance and water retentiveness, the aluminum sheet web was subjected to anodic oxidation to form an oxide film thereon. Specifically, the aluminum sheet web was passed through an aqueous electrolytic solution of 20% sulfuric acid at 35° C. and electrolyzed therein with a direct current of 14 A/cm$^2$ being applied to the solution from an indirect electric cell. By this anodic oxidation, the aluminum sheet web had an oxide film of 2.5 g/m$^2$ formed thereon.

Next, this was treated with a silicate. This treatment is for ensuring hydrophilicity of the non-image area of the printing plate having the aluminum, sheet as the support. Specifically, the aluminum sheet web was passed through an aqueous 1.5% sodium silicate (#3) solution at 70° C. Contact time was 15 seconds. Then, the web was washed with water. The amount of Si deposited on the web was 10 mg/m$^2$. The center line average height, Ra, of the thus-processed aluminum sheet was 0.25 mm. The aluminum sheet served as the support of the printing plate that was produced.

Subbing Layer

Next, the aluminum support was coated with a subbing solution (composition shown below) by use of a wire bar, and dried with a hot air drier at 90° C. for 30 seconds. After drying, the thickness of the subbing layer formed was 10 mg/m$^2$.

Subbing Solution

| | |
|---|---|
| 75/15 by mol copolymer of ethyl methacrylate and sodium 2-acrylamido-2-methyl-1-propanesulfonate | 0.1 g |
| 2-aminoethylphosphonic acid | 0.1 g |
| Methanol | 50 g |
| Ion-exchange water | 50 g |

Photosensitive Layer

Next, a photosensitive layer solution [P] (composition shown below) was prepared. Immediately after preparation, the solution [P] was applied to the subbing layer-coated aluminum sheet by use of a wire bar, and then dried with a hot air drier at 115° C. for 45 seconds. In this manner, plates [P-1] to [P-6] to be processed into negative lithographic printing plates were produced. After drying, the amount of the photosensitive layer formed on each plate was 1.3 g/m$^2$. IR absorbers and onium salts used in the photosensitive solution [P] are shown in Table 1. The reflection density at an absorption peak in the IR range of the photosensitive layer of each plate was measured. For all plates, the reflection density fell between 0.6 and 1.2.

Coating Solution [P] for Photosensitive Layer

| | |
|---|---|
| IR absorber (IR-A, structure shown below) | 0.10 g |
| Onium salt (shown in Table 1) | 0.30 g |
| Reducing additive (shown in Table 1) | 0.20 g |
| Dipentaerythritol hexaacrylate | 1.00 g |
| 80/20 by mol copolymer of allyl methacrylate and methacrylic acid (weight-average molecular weight: 120,000) | 0.80 g |
| Victoria Pure Blue naphthalenesulfonate | 0.04 g |
| Fluorine-containing surfactant (MEGAFAC F-176, manufactured by Dai-Nippon Ink and Chemicals Inc.) | 0.01 g |
| Methyl ethyl ketone | 9.0 g |
| Methanol | 10.0 g |
| 1-Methoxy-2-propanol | 8.0 g |

TABLE 1

| | Lithographic Printing Plate | Reducing additive | Onium Salt |
|---|---|---|---|
| Example 1 | [P-1] | M-12 | OI-5 |
| Example 2 | [P-2] | M-18 | OI-5 |
| Example 3 | [P-3] | M-31 | OI-5 |
| Example 4 | [P-4] | M-40 | OI-5 |
| Example 5 | [P-5] | M-47 | OS-4 |
| Example 6 | [P-6] | M-53 | OS-4 |
| Comp. Ex. 1 | [Q-1] | — | OI-5 |
| Comp. Ex. 2 | [Q-2] | — | OS-4 |

I R-A

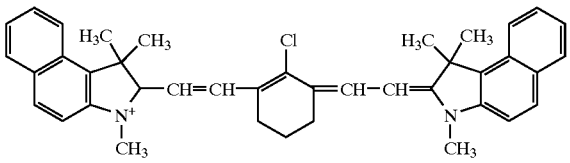

-continued

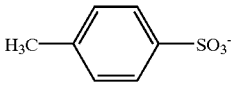

Exposure

The negative lithographic printing plates [P-1] to [P-6] were imagewise exposed to IR radiation, using TRENDSETTER 3244VFS, manufactured by Creo, with a water-cooled 40 W IR semiconductor laser mounted therein. Output power was 9 W; drum speed was 210 rpm; energy at the plate was 100 mJ/cm$^2$; and image resolution was 2400 dpi.

Development

After having been thus exposed, the plates were processed by use of an automatic processor, STABLON 900 N, manufactured by Fuji Photo Film Co., Ltd. For both an original developer and a replenisher, DN-3C, manufactured by Fuji Photo Film Co., Ltd., was used, diluted 1/1 with water. The temperature of a developer bath was 30° C. For a finisher, FN-6, manufactured by Fuji Photo Film Co., Ltd., was used, diluted 1/1 with water (pH=10.8).

Evaluation of Printability of Printing Plates

The thus-processed lithographic printing plates [P-1] to [P-6] were tested for printability. Specifically, each printing plate was set in a Heidelberg printer, HEIDEL SOR-M, which was driven to produce prints with commercially-available oily ink. The prints were visually checked for stains in non-image areas. The results are given in Table 2. No stains were found in all prints from all the printing plates tested.

Number of Good Prints

Next, the lithographic printing plates [P-1] to [P-6] were tested in a printer produced by Komori Corporation, LITHLON, to check how many good prints could be obtained therefrom. Specifically, all the prints were visually checked for ink density, and the number of good prints from each printing plate tested was counted. The results are given in Table 2.

Comparative Examples 1 and 2

A photosensitive solution [P] was prepared in the same manner as in Examples 1 and 5, except that the amount of the allyl methacrylate/methacrylic acid copolymer (80/20 by mol) was 1.00 g and not 0.80 g, and the reducing additive was not used. The coating solution thus prepared was applied to the aluminum sheet supports, and dried. The Comparative Example lithographic printing plates thus produced herein are referred to as [Q-1] and [Q-2]. Details of the onium salts used therein are shown in Table 1.

TABLE 2

| | Lithographic Printing Plate | Stains in Non-image Area | Number of Good Prints |
|---|---|---|---|
| Example 1 | [P-1] | no | 66,000 |
| Example 2 | [P-2] | no | 60,000 |
| Example 3 | [P-3] | no | 61,000 |
| Example 4 | [P-4] | no | 66,000 |
| Example 5 | [P-5] | no | 65,000 |
| Example 6 | [P-6] | no | 54,000 |
| Comp. Ex. 1 | [Q-1] | no | 44,000 |
| Comp. Ex. 2 | [Q-2] | no | 42,000 |

As is obvious from Table 2, the lithographic printing plates of the present invention, in which the photosensitive layer contained a reducing additive, gave a larger number of good prints with no stain in the non-image area, even though they were imagewise exposed and then developed and processed without being heated after the exposure. The prints from the Comparative Example printing plates, in which the photosensitive layer did not contain a reducing additive, also had no stains in the non-image area, but the number of good prints therefrom was smaller than that from the printing plates of the present invention.

Examples 7 to 12

Preparation of Support

An aluminum support was formed in the same manner as in Examples 1 to 6, except that the support was not subjected to the silicate treatment for hydrophilicity.

Subbing Layer

Next, the aluminium support was coated with a subbing solution (composition shown below) by use of a wire bar, and dried with a hot air drier at 90° C. for 30 seconds. After drying, the thickness of the subbing layer formed was 10 mg/m$^2$.

Subbing Solution

| | |
|---|---|
| β-alanine | 0.1 g |
| Phenylphosphonic acid | 0.1 g |
| Methanol | 40 g |
| Pure water | 60 g |

Photosensitive Layer

A photosensitive layer solution [P] was prepared in the same manner as in Examples 1 to 6, except that an IR absorber, IR-B (structure shown below) was used rather than IR-A, and onium salts and reducing additives shown in Table 3 below were used. Also in the same manner as in Examples 1 to 6, the coating solution thus prepared was applied to the subbing layer-coated aluminium sheet by use of a wire bar, and then dried. In this manner, plates [P-7] to [P-12] to be processed into negative lithographic printing plates were produced.

I R-B

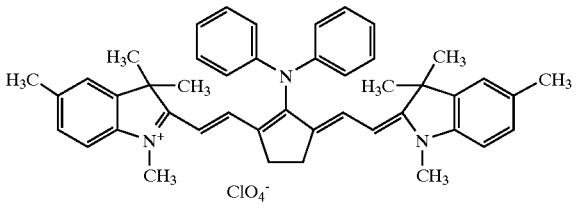

Comparative Examples 3 and 4

A photosensitive layer solution [P] was prepared in the same manner as in Examples 7 and 11, but the amount of the allyl methacrylate/methacrylic acid copolymer (80/20 by mol) was 1.00 g and not 0.80 g, and the reducing additive was not used. The coating solution thus prepared was applied to the supports, and dried. The Comparative Example lithographic printing plates thus produced herein are referred to as [Q-3] and [Q-4]. Details of the onium salts used therein are shown in Table 3.

TABLE 3

| | Lithographic Printing Plate | Reducing additive | Onium Salt |
|---|---|---|---|
| Example 7 | [P-7] | M-11 | OI-5 |
| Example 8 | [P-8] | M-20 | OI-5 |
| Example 9 | [P-9] | M-33 | OI-5 |
| Example 10 | [P-10] | M-42 | OI-5 |
| Example 11 | [P-11] | M-49 | OS-6 |
| Example 12 | [P-12] | M-53 | OS-6 |
| Comp. Ex. 3 | [Q-3] | — | OI-5 |
| Comp. Ex. 4 | [Q-4] | — | OS-6 |

These plates were exposed and processed in the same manner as in Examples 1 to 6, except that the following developer was used. Thus, the lithographic printing plates [P-7] to [P-12] and [Q-3] and [Q-4] were obtained.

Developer

| | |
|---|---|
| Potassium hydroxide | 3.8 g |
| Polyethylene glycol mononaphthyl ether | 250 g |
| Sodium ethylenediaminetetraacetate | 8 g |
| Water | 738 g |
| (pH = 11.7) | |

Also in the same manner as in Examples 1 to 6, these printing plates were tested for printability. The prints therefrom were visually checked for stains in non-image areas. The results are given in Table 4.

TABLE 4

| | Lithographic Printing Plate | Stains in Non-image Area | Number of Good Prints |
|---|---|---|---|
| Example 7 | [P-7] | no | 77,000 |
| Example 8 | [P-8] | no | 70,000 |
| Example 9 | [P-9] | no | 68,000 |
| Example 10 | [P-10] | no | 75,000 |
| Example 11 | [P-11] | no | 70,000 |
| Example 12 | [P-12] | no | 65,000 |
| Comp. Ex. 3 | [Q-3] | no | 54,000 |
| Comp. Ex. 4 | [Q-4] | no | 55,000 |

As is obvious from Table 4, the lithographic printing plates of the present invention, [P-7] to [P-12] gave a larger number of good prints with no stains in non-image areas.

The prints from the Comparative Example printing plates of Comparative Examples 3 and 4, in which the recording layer did not contain a reducing additive, had no stains in non-image areas, but the numbers of good prints therefrom were smaller than the numbers from the printing plates of the present invention, even though the recording layers were otherwise the same.

The present invention provides a negative image-recording material which can be imagewise exposed to IR radiation from an IR-emitting solid laser or semiconductor laser and ensures direct image formation thereon from the digital data of a computer or the like, and which, when used in a lithographic printing plate, exhibits good printing durability, even if it is not heated for image formation thereon, and ensures a large number of good prints from the printing plate.

What is claimed is:

1. A negative image-recording material for heat-mode exposure, the material comprising: (A) an IR absorber; (B) a radical generator having an onium salt structure; (C) a radical-polymerizing compound; and (D) a reducing additive, the material being recordable by exposure with IR radiation, wherein the radical-polymerizing compound is selected from the group consisting of an unsaturated carboxylic acid, an ester of an unsaturated carboxylic acid, and an amide of an unsaturated carboxylic acid.

2. A negative image-recording material for heat-mode exposure, the material comprising: (A) an IR absorber; (B) a radical generator having an onium salt structure; (C) a radical-polymerizing compound; and (D) a reducing additive, the material being recordable by exposure with IR radiation, and the IR absorber being one of an IR-absorbing dye and an IR-absorbing pigment, for converting absorbed light into heat, and having an absorption peak at a wavelength from 760 to 1200 nm, wherein the radical-polymerizing compound is selected from the group consisting of an unsaturated carboxylic acid, an ester of an unsaturated carboxylic acid, and an amide of an unsaturated carboxylic acid.

3. The negative image-recording material as claimed in claim 1, wherein the IR absorber are cyanine dyes of the following general formula (I):

General formula (I)

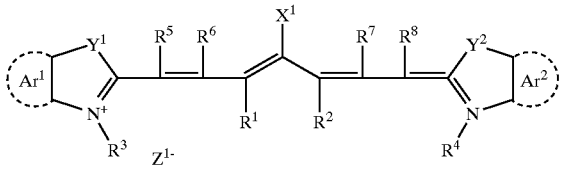

wherein $X^1$ represents a halogen atom, $X^2$—$L^1$ or $X^2$—$(L^1)_2$; $X^2$ represents an oxygen, sulfur or nitrogen atom; $L^1$ represents a hydrocarbon group having from 1 to 12 carbon atoms, or a heterocyclic group; and $R^1$ and $R^2$ each independently represents a hydrocarbon group having from 1 to 12 carbon atoms; and $Ar^1$ and $Ar^2$ may be the same or different, and each represents an optionally-substituted aromatic hydrocarbon group; and $Y^1$ and $Y^2$ may be the same or different, and each represents a sulfur atom or a dialkylmethylene group having at most 12 carbon atoms; and $R^3$ and $R^4$ may be the same or different, and each represents an optionally-substituted hydrocarbon group having at most 20 carbon atoms; and $R^5$, $R^6$, $R^7$ and $R^8$ may be the same or different, and each represents a hydrogen atom, or a hydrocarbon group having at most 12 carbon atoms; and $Z^{1-}$ represents a counter ion required for charge neutralization.

4. The negative image-recording material as claimed in claim 3, wherein $R^1$ and $R^2$ are bonded to each other to form a 5-membered or 6-membered ring.

5. The negative image-recording material as claimed in claim 1, wherein the IR absorber is contained in the material in an amount of from 0.1 to 20% by weight of total solid content of the material.

6. The negative image-recording material as claimed in claim 1, wherein the radical generator having an onium salt structure is an onium salt selected from the group consisting of iodonium salts, diazonium salts and sulfonium salts.

7. The negative image-recording material as claimed in claim 2, wherein the radical generator having an onium salt structure is an onium salt selected from the group consisting of iodonium salts, diazonium salts and sulfonium salts.

8. The negative image-recording material as claimed in claim 1, wherein the radical generator having an onium salt structure comprises an onium salt represented by the following general formula (III):

$$Ar^{11}—I^+—Ar^{12}Z^{11-} \qquad \text{General formula (III)}$$

in which: $Ar^{11}$ and $Ar^{12}$ each independently represents an optionally substituted aryl group having at most 20 carbon atoms; and $Z^{11-}$ represents a counter ion selected from the group consisting of halide ions, perchlorate ions, tetrafluoroborate ions, hexafluorophosphate ions, carboxylate ions and sulfonate ions.

9. The negative image-recording material as claimed in claim 1, wherein the radical generator having an onium salt structure comprises an onium salt represented by the following general formula (IV):

$$Ar^{21}—N^+{\equiv}N\ Z^{21-} \qquad \text{General formula (IV)}$$

in which: $Ar^{21}$ represents an optionally substituted aryl group having at most 20 carbon atoms; and $Z^{21-}$ represents a counter ion selected from the group consisting of halide ions, perchlorate ions, tetrafluoroborate ions, hexafluorophosphate ions, carboxylate ions and sulfonate ions.

10. The negative image-recording material as claimed in claim 1, wherein the radical generator having an onium salt structure comprises an onium salt represented by the following general formula (V):

General formula (V)

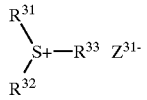

in which: each of $R^{31}$, $R^{32}$ and $R^{33}$ may be the same as and may be different from another of $R^{31}$, $R^{32}$ and $R^{33}$, and represents an optionally substituted hydrocarbon group having at most 20 carbon atoms; and $Z^{31-}$ represents a counter ion selected from the group consisting of halide ions, perchlorate ions, tetrafluoroborate ions, hexafluorophosphate ions, carboxylate ions and sulfonate ions.

11. The negative image-recording material as claimed in claim 1, wherein the radical generator having an onium salt structure is contained in the material in an amount of from 0.1 to 50% by weight of total solid content of the material.

12. The negative image-recording material as claimed in claim 1, wherein the radical-polymerizing compound has at least one terminal ethylenically unsaturated double bond.

13. The negative image-recording material as claimed in claim 2, wherein the radical-polymerizing compound has at least one terminal ethylenically unsaturated double bond.

14. The negative image-recording material as claimed in claim 1, wherein the reducing additive has a reaction rate constant with respect to radicals of at least $1\times10^5 M^{-1}sec^{-1}$; the reaction rate constant with respect to onium salts of the electron donor formed through radical reaction is at least $1\times10^6 M^{-1}sec^{-1}$; the oxidation potential of the electron donor is −0.3 V (vs. SCE) or less.

15. The negative image-recording material as claimed in claim 14, wherein the reducing additive is selected from the group consisting of ether hydrogen donors, alcohol hydrogen donors, vinyl ethers, and phosphine compounds.

16. The negative image-recording material as claimed in claim 2, wherein the reducing additive has a reaction rate constant with respect to radicals of at least $1\times10^5 M^{-1}sec^{-1}$; the reaction rate constant with respect to onium salts of the electron donor formed through radical reaction is at least $1\times10^6 M^{-1}sec^{-1}$; the oxidation potential of the electron donor is −0.3 V (vs. SCE) or less.

17. The negative image-recording material as claimed in claim 16, wherein the reducing additive is selected from the group consisting of ether hydrogen donors, alcohol hydrogen donors, vinyl ethers, and phosphine compounds.

18. The negative image-recording material as claimed in claim 15, wherein the ether hydrogen donors are selected from the group consisting of cyclic ether compounds represented by one of the following general formulae (i) and (ii) and polyethers represented by the following general formula (iii):

(i)

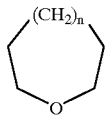

(ii)

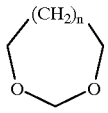

(iii)

$$R^2—(R^1—O)_m—R^3$$

in which: n indicates 0, 1 or 2; m indicates an integer of at least 2; $R^1$ represents a divalent alkylene group; and $R^2$ and $R^3$ each represents a monovalent organic group.

19. The negative image-recording material as claimed in claim 15, wherein the alcohol-type hydrogen donors comprise secondary alcohol compounds represented by the following general formula (iv):

(IV)

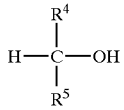

in which $R^4$ and $R^5$ each represents a monovalent or divalent organic group.

20. The negative image-recording material as claimed in claim 15, wherein the vinyl ethers comprise compounds represented by the following general formula (v):

in which $R^{10}$ to $R^{15}$ each independently represents a monovalent or divalent organic group.

21. The negative image-recording material as claimed in claim 17, wherein the phosphine-type compounds comprise compounds represented by one of the following general formulae (vi) and (vii):

in which $R^{10}$ to $R^{15}$ each independently represents a monovalent or divalent organic group.

22. The negative image-recording material as claimed in claim 1, wherein the reducing additive is contained in the material in an amount of from 0.1 to 70% by weight of total solid content of the material.

23. The negative image-recording material as claimed in claim 1, wherein the radical-polymerizing compound is one of an ester of an unsaturated carboxylic acid and an aliphatic polyalcohol; and an amide of an unsaturated carboxylic acid and an aliphatic polyamine.

24. The negative image-recording material as claimed in claim 1, wherein the radical-polymerizing compound is one of a (meth)acrylate and a (meth)acrylamide.

* * * * *